US007794017B2

(12) United States Patent
Kan et al.

(10) Patent No.: US 7,794,017 B2
(45) Date of Patent: Sep. 14, 2010

(54) CHAIR HAVING A UNIT TO MOVE A LUMBAR SUPPORT

(75) Inventors: Satoshi Kan, Osaka (JP); Katunori Hama, Osaka (JP); Tamio Sakurai, Osaka (JP); Yasuhiro Nakamura, Tokyo (JP)

(73) Assignee: Itoki Corporation, Osaka-shi, Osaka (JP)

( * ) Notice: Subject to any disclaimer, the term of this patent is extended or adjusted under 35 U.S.C. 154(b) by 290 days.

(21) Appl. No.: 12/063,742

(22) PCT Filed: Aug. 18, 2006

(86) PCT No.: PCT/JP2006/316256

§ 371 (c)(1),
(2), (4) Date: Feb. 13, 2008

(87) PCT Pub. No.: WO2007/021005

PCT Pub. Date: Feb. 22, 2007

(65) Prior Publication Data

US 2009/0146476 A1 Jun. 11, 2009

(30) Foreign Application Priority Data

| | | |
|---|---|---|
| Aug. 18, 2005 | (JP) | 2005-237660 |
| Aug. 23, 2005 | (JP) | 2005-240740 |
| Nov. 30, 2005 | (JP) | 2005-346602 |

(51) Int. Cl.
*A47C 1/00* (2006.01)
*A47C 7/46* (2006.01)

(52) U.S. Cl. ..... 297/340; 297/284.4

(58) Field of Classification Search ..... 297/300.1, 297/284.4, 340, 284.7, 284.8
See application file for complete search history.

(56) References Cited

U.S. PATENT DOCUMENTS 233,140 A * 10/1880 Candrian ..... 297/284.4

(Continued)

FOREIGN PATENT DOCUMENTS

JP 44-20784 9/1969

(Continued)

*Primary Examiner*—Milton Nelson, Jr.
(74) *Attorney, Agent, or Firm*—Drinker Biddle & Reath LLP

(57) ABSTRACT

A front portion of a seat 2 is connected to a base 6 by a front support link 7 and a first support shaft 8, and a rear portion of the seat 2 is connected to a rocking frame 11 by way of a rear support link 14. The first support shaft 8 is slidably fitted to the base 6. An upper portion of the backrest 3 is attached to an upper portion of a back frame 12. When a person is seated, the seat 2 is moved down and moved back, and a lumber support portion 17*a* of the backrest 3 is moved forwardly in cooperation with movement of the seat 2. Therefore, even when a person is shallowly seated on a chair, the waist portion of the person can precisely be supported. The cooperatively moving means includes a cooperatively moving link mechanism comprising a first through a fifth cooperatively moving link 43, 46, 48, 21 and 20. The third link 48 can be pivoted to return against an elasticity of a second returning spring 49. Therefore, a person is not hampered from being seated thereon deeply.

6 Claims, 25 Drawing Sheets

U.S. PATENT DOCUMENTS

| | | | |
|---|---|---|---|
| 2003/0137173 | A1 | 7/2003 | Kinoshita et al. |
| 2004/0046432 | A1 | 3/2004 | Ball et al. |

FOREIGN PATENT DOCUMENTS

| | | |
|---|---|---|
| JP | 46-27517 | 8/1971 |
| JP | 2002-119375 | 4/2002 |
| JP | 2003-135204 | 5/2003 |
| WO | WO 86/02243 | 4/1986 |

* cited by examiner

FIG. 7A
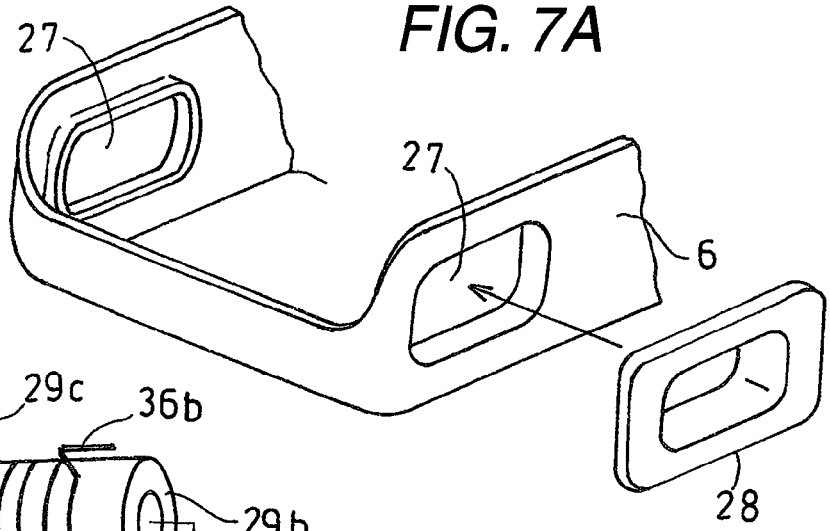
FIG. 7B
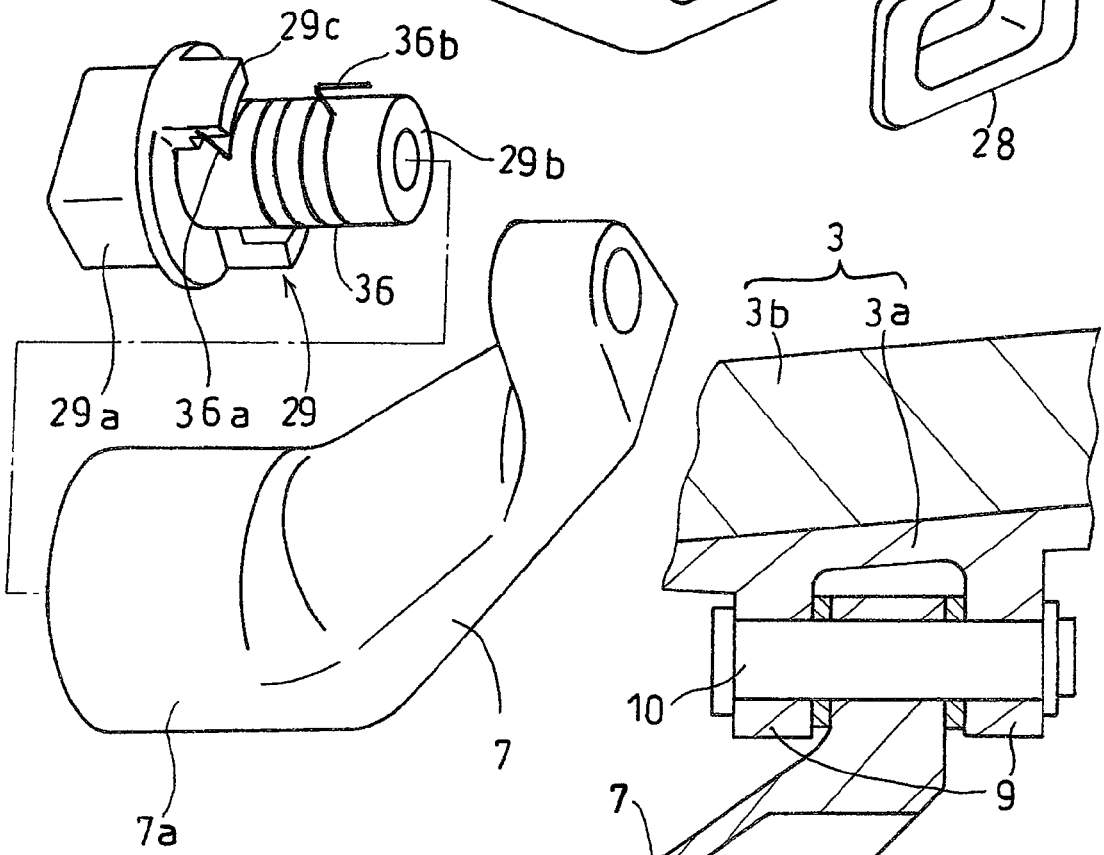
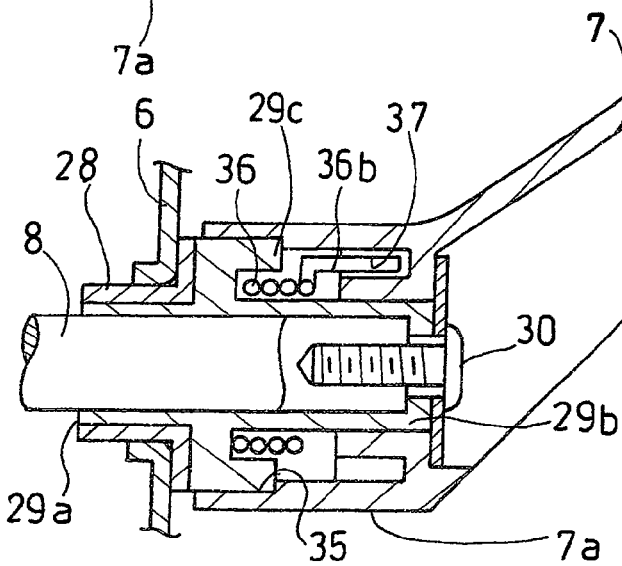
FIG. 7C

FIG. 13A
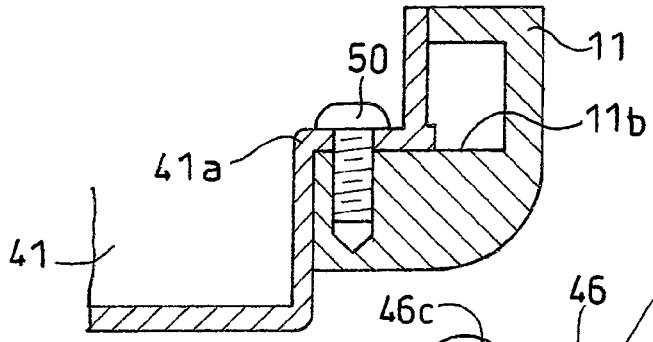
FIG. 13B
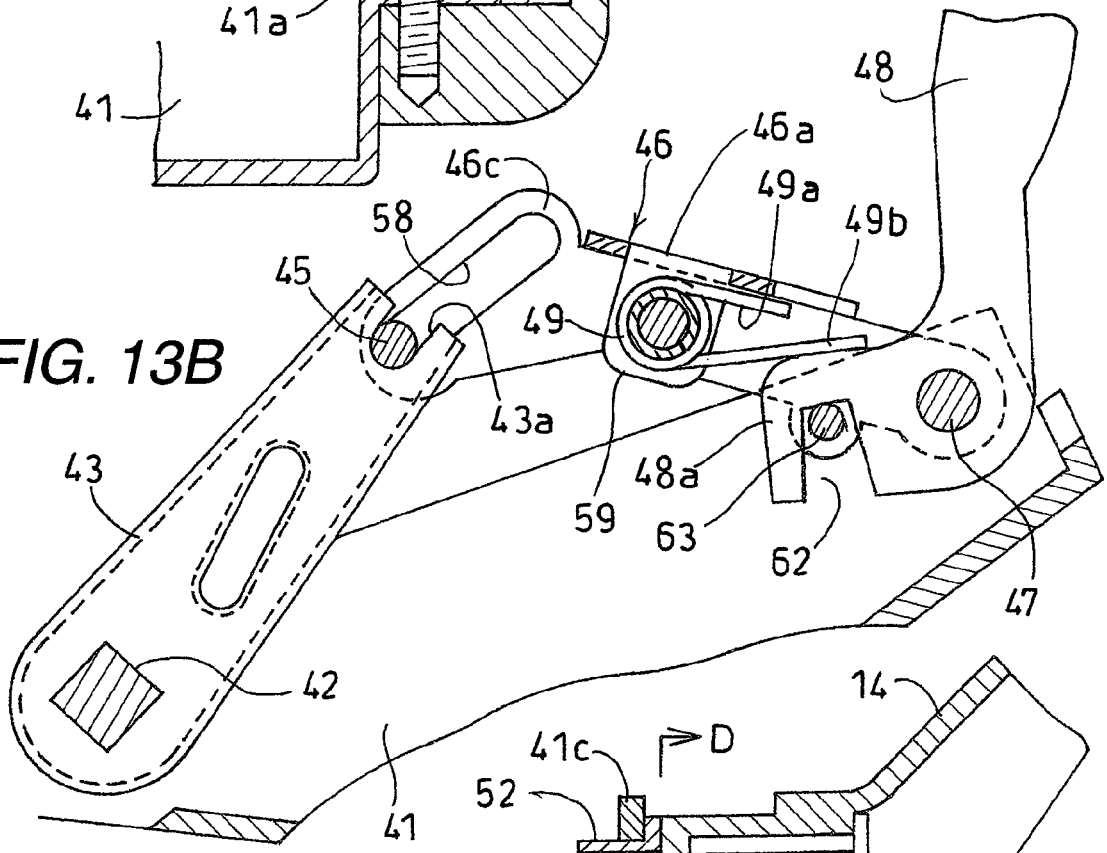
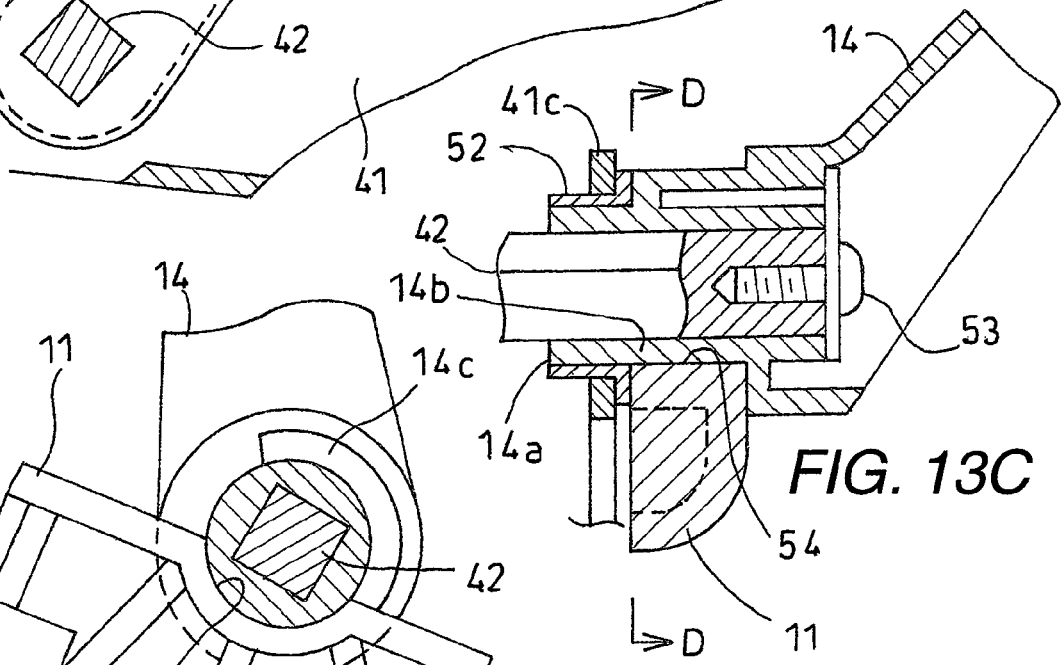
FIG. 13C
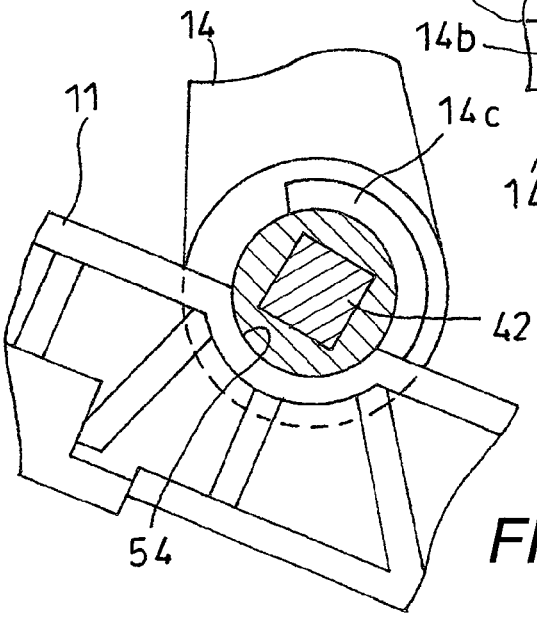
FIG. 13D

FIG. 26B
FIG. 26A
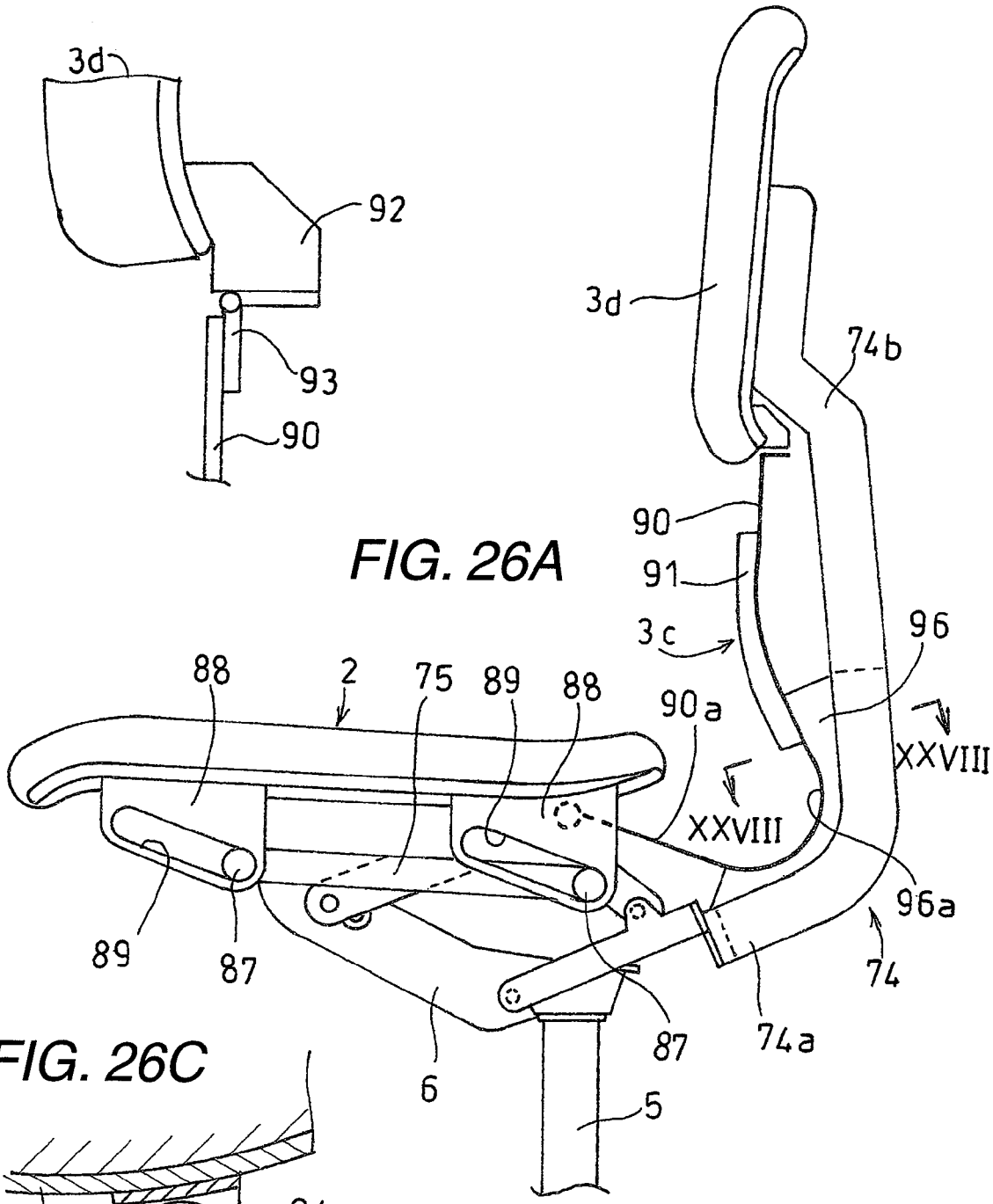
FIG. 26C
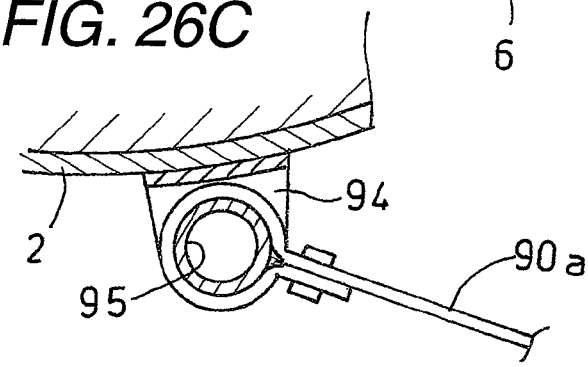

CHAIR HAVING A UNIT TO MOVE A LUMBAR SUPPORT

TECHNICAL FIELD

The present invention relates to a chair having a backrest.

BACKGROUND ART

There are various kinds of chairs and various improvements are carried out in accordance with the respective kinds. As an example, Patent Reference 1 discloses a chair in which a seat is inclined forward when a seated person leans on a backrest. On the other hand, Patent Reference 2 describes a chair in which when a person is seated, a seat is inclined centering on substantially a middle portion in a front and rear direction in a side view thereof and a backrest is inclined by being moved cooperatively with inclining the seat rearward. In both of the patent references, as means for cooperatively moving the backrest with the seat, a kind of a link mechanism is adopted.

According to Patent Reference 1, both of the seat and the backrest remain unchanged in attitudes thereof by only when a person is seated thereon, when the seated person leans on the backrest to apply a large moment to the backrest, a rear portion of the seat is pushed up upwardly to incline the seat forward by a principle of lever and it is an object of the invention to eliminate a sense of oppression of the thigh of a person in a rocking state.

On the other hand, according to Patent Reference 2, when a person is seated on the chair deeply, the attitude of the backrest remains unchanged so far as the person does not lean on the backrest, for example, when the person is seated on a front portion of the seat, the backrest is inclined forward considerably, and the back of the person is pushed by an upper portion of the backrest. Then, a user is brought into a state of falling forward to feel an unpleasant feeling, hence, a seated position is shifted rearward. According to Patent Reference 2, the person adopts a correct seating attitude by giving the pleasant feeling when the person is seated on the front portion of the seat. Therefore, the chair disclosed in Patent Reference 2 can be said to be a kind of a disciplinary chair.

Patent Reference 1: JP-B-44-20784

Patent Reference 2: JP-B-46-27517

DISCLOSURE OF THE INVENTION

Problems that the Invention is to Solve

For example, when a person uses a chair at an office, the person is not necessarily seated thereon deeply but is frequently seated thereon shallowly. When a person carries out an operation in an attitude of leaning forward, the person is frequently seated thereon shallowly. There also is a case in which the person is difficult to be seated thereon deeply since the body is small. Further, there also is a person falling into a habit of being seated thereon shallowly.

In any of the cases, it is a fact that as an actual mode of using a chair, the person is frequently seated thereon shallowly. On the other hand, according to a chair of recent years, in order to alleviate a burden on the body of a seated person, an importance of a lumber support function of supporting the waist portion from a rear side. That is, when the waist portion is supported from the rear side, a person is held in a state of stretching the back muscle, and therefore, a burden of the lumber vertebra and the pelvis is remarkably reduced. Hence, in recent years, a chair attached with a lumber support for concentrically supporting the lumber vertebra portion of a person has been spread.

However, when a person is shallowly seated on a chair, a space is left between the backrest and the waist, and therefore, the person is liable to be brought into a stooped state, then, the burden on the lumber vertebra is increased to cause a pain at the waist, or causes a gastroentric disorder by oppressing the internal organs.

Therefore, there is requested a user friendly and advanced chair achieving a lumber support function even when a person is seated thereon shallowly. However, Patent Reference 1 assumes only the rocking state and any consideration is not given to the case of being seated thereon shallowly. On the other hand, according to the chair of Patent Reference 2, when a person is seated thereon shallowly, the person is pushed to a stooped attitude, and therefore, the burden on the waist of the user is rather increased. Therefore, the chair is difficult to be applied to a chair of an office.

The invention has been carried out with an object of improving such a current situation.

MEANS FOR SOLVING THE PROBLEMS

A chair of the invention includes a seat and a backrest as indispensable elements. Further, whereas the seat is supported by a seat receiving member to carry out at least one movement of a downward movement, a rearward movement and an inclining movement when a person is seated thereon, the backrest constitutes a lumber support portion capable of supporting the waist portion of the seated person at a lower portion thereof and is attached to a back supporter in a state of capable of forwardly moving the lumber support portion by a large amount. Further, the chair further includes cooperatively moving means for forwardly moving the lumber support portion of the backrest by the movement of the seat by making the person seated thereon.

According to the invention, the lumber support portion of the backrest is moved forwardly by making the person seated thereon, and therefore, even when the person is seated thereon shallowly, the waist portion (lumber vertebra) of the seated person can be supported from a rear side, as a result, an attitude having a small burden can be adopted by stretching the back muscle.

According to the invention, in order to achieve an effect thereof, it is necessary that the lumber support portion of the backrest is moved forwardly by a large amount by making the person seated thereon, as an axial dimension, it is preferable to move the chair forwardly by, for example, about 100 mm. Further, when the seat is moved rearwardly, it is preferable to set a sum of a dimension of moving the seat rearwardly and a dimension of moving the lumber support portion forwardly to about 100 mm. Naturally, the numeral is a yardstick and a constitution of capable of adjusting a dimension of relatively moving the lumber support portion forwardly in steps (for example, an interval of 30 mm) can also be adopted. It is preferable that a dimension of relatively moving the lumber support portion forwardly is at least about 50 mm.

The invention includes a number of variations described below by constituting basic invention by the above-described constitution.

(1). First Variation

In a first variation of the invention, the seat is supported by a seat receiving portion to carry out at least the downward movement without hardly changing an attitude in a side view thereof when the person is seated thereon, and the lumber support portion of the backrest is moved forwardly by at least the downward movement of the movement of the seat. Further, "hardly changing" of the invention includes both of a state of not changing at all and a state of changing more or less.

Although according to Patent Reference 2 mentioned above, the seat is inclined forwardly when seated thereon shallowly, and therefore, there is a problem that a person is brought into a state of being stooped forwardly and it is difficult to stretch the back muscle, according to the first variation of the invention, the attitude of the seat in the side view is hardly changed, and the pelvis of a user is maintained in a stable state by the seat. Therefore, the chair is preferable as a chair used in a desk work such as, for example, a personal computer operation. Further, the invention also includes a constitution of moving the lumber support portion of the backrest forwardly in cooperation with a forward inclining movement or a rearward inclining movement of the seat. It may be selected with which movement of the seat the forward movement of the lumber support portion is cooperatively moved by use of the chair.

(2). Second Variation

A second variation of the invention is applied to a rocking chair a backrest of which is inclined rearwardly, the chair includes a base provided at an upper end of a leg, a back support frame rearwardly inclinably connected to the base, and a rocking spring for elastically supporting a rearward inclining movement of the back support frame other than the seat and the backrest.

Further, the seat is supported by the base and the back support frame to carry out the downward movement and the rearward inclining movement without hardly changing an attitude in a side view thereof when the person is seated thereon, and therefore, the back support frame serves also as the seat receiving member and the back supporter, further, a spring force of the rocking spring is set to a strength by which the rocking spring is not elastically deformed even when the person is seated but is elastically deformed after the seated person leans on the backrest.

In the second variation of the invention, the seat is moved down and moved back when a person is seated thereon, and therefore, the lumber support portion of the backrest is made to be easy to be proximate to the waist portion of the person. Therefore, the lumber support function in a state of being seated shallowly is precisely achieved. Further, the rocking spring is not deformed only by being seated, and therefore, the rocking function can also be maintained firmly without hampering the lumber support function when seated shallowly.

(3). Third Variation

Also in a third variation of the invention, the chair includes a base provided at an upper end of a leg, a back support frame connected rearwardly inclinably to the base, and a rocking spring for elastically supporting a rearward inclining movement of the back support frame other than the seat and the backrest.

Further, in the third variation, the seat is connected to the base and the back support frame to carry out the downward movement and the rearward movement without hardly changing an attitude in a side view thereof when the person is seated thereon by way of a first link mechanism, further, whereas the seat is pressed in a direction of carrying out an upward movement by the spring, the back support frame is provided with a second link mechanism for converting the rearward movement and a downward movement of the seat into a forward movement of the lumber support portion of the backrest, and the second link mechanism constitutes a core of the cooperatively moving means.

Various modes can be adopted as means for moving a seat by being seated, further, a variety of development can be carried out for the cooperatively moving means, and when the mechanism of moving the seat and the link mechanism as the cooperatively moving means are adopted as in the third variation, an advantage of capable of ensuring the firm movement is achieved by a simple structure.

(4). Fourth Variation

In a fourth variation of the invention, the cooperatively moving means includes spring means as a transmitting member for converting movement of the seat by being seated into a forward movement of the lumber support portion of the backrest, and the forwardly moved lumber support portion is permitted to be moved back against the spring means.

A person is not always seated shallowly but there also is a case in which a person is seated deeply. Further, a front/rear position of being seated is various. Further, in the fourth variation of the invention, the moved forward lumber support portion can be moved rearwardly against the spring means, and therefore, the lumber support portion can be maintained at the front/rear position in accordance with the seated position of the person. Therefore, the variation is particularly preferable.

Further, when a person moves the lower half body to shift rearwardly in a state of being seated on the chair shallowly, the moved forward lumber support portion is moved rearwardly against the spring means. On the other hand, although there is a case of being seated deeply from the start, in this case, at a time point of being seated, the waist portion is brought into contact with the lumber support portion, and therefore, the lumber support portion is not moved forwardly at all or hardly moved forwardly and only the seat is moved down and moved back.

(5). Fifth and Sixth Variations

A fifth variation of the invention is characterized in the backrest, and according to the invention, the backrest is provided with a flexibility to be able to deform a side view shape and a plane view shape thereof by being pressed by the seated person, an upper portion thereof is connected to the back supporter, the lumber support portion is connected to the cooperatively moving means, and the lumber support portion is moved forwardly and rearwardly by inclining the backrest centering on the upper portion in a side view thereof.

The sixth variation is a preferable example of the fifth variation, according to the sixth variation of the invention, in the fifth variation of the invention, the backrest includes a back plate comprising a synthetic resin including elastomer, and numbers of vertically prolonged ribs are formed at a front face or a rear face or both front and rear faces of the back plate.

The fifth and the sixth variations of the invention achieve an advantage of capable of promoting a fitness of the backrest for the body of a person. Particularly, the sixth variation of the invention is excellent in the fitness of the body and ensures the flexibility of a touch to the body of the person by constituting the material by constituting the material of the back plate by the rubber matter synthetic resin including elastomer.

Meanwhile, when the backrest is excessively flexible, there is a concern that a person rather feels a strange feeling. That is, it is preferable that the backrest is provided with a rigidity to some degree. In this respect, when a number of vertically prolonged ribs are formed in the sixth variation of the invention, there is brought about a state in which while maintaining a shape in a side view so as not to be changed excessively by a pertinent rigidity, in a plane view thereof, the chair can be deformed easily to wrap the body of the person. Therefore, the sixth variation of the invention is particularly preferable. Further, in the sixth variation of the invention, it is possible to expose the back plate (that is, not to expand a cushion thereon), in this case, there is achieved an advantage of being excellent in air permeability when the vertically prolonged rib is formed at the front face of the back plate.

(6). Seventh Variation

In a seventh variation of the invention, in the basic invention, the backrest includes a flexible lumber support portion capable of being bent to deform in a side view thereof, and a main support portion disposed upward from the lumber support portion and hardly having a flexibility. Further, whereas the main support portion of the backrest is attached to the back support frame, an upper end of the lumber support portion is connected to an upper support portion or a back support frame and a lower end thereof is movably held.

Further, the lumber support portion is provided with a directionality of deformation such that when a lower portion thereof is moved upwardly by receiving a stretching operation from a lower side, the lumber support portion is bent in a projected shape by a large amount and moved forwardly in a side view thereof. Further, the back support frame is further provided with guiding means for moving the lower portion of the lumber support portion upwardly when the person is seated and the guiding means constitutes a portion of the cooperatively moving means.

According to the seventh variation of the invention, when a stretching force is operated to the lumber support portion, the lumber support portion is elastically deformed in the forward projected shape, and the lumber support portion is moved forwardly by the elastic deformation. Further, in the seventh variation of the invention, the lumber support portion is moved forwardly by being deformed, and therefore, the cooperatively moving means becomes extremely simple. The point is the remarkable characteristic of the seventh variation.

(7). Eighth Variation

An eighth variation is a preferable example of the seventh variation. The eighth variation of the invention includes a base provided at an upper end of a leg, a back support frame connected rearwardly inclinably to the base, and a rocking spring for elastically supporting a rearward inclining movement of the back support frame in the seventh variation of the invention. The seat is supported by the base and the back support frame by way of the guiding means to carry out the rearward movement and the downward movement without hardly changing an attitude in a side view thereof when the person is seated thereon, and therefore, the back support frame serves also as the seat receiving member and the back supporter.

Further, a downward directed extended portion having a flexibility is continuous to a lower portion of the lumber support portion, a front end thereof is connected to a rear portion of the seat, further, the back support frame is provided with a guide portion by which when the seat is moved down and moved back, the downward directed extended portion of the lumber support portion is moved to the main support portion of the back rest. The eighth variation of the invention is constituted by a simple structure of pressing the downwardly directed extended portion of the lumber support portion by the seat, and therefore, the constitution is further firmly simplified.

(8). Other Variations

The invention includes also other variations. For example, the first through the sixth variations can also be combined. Further, there can also be provided switching means for selecting a state of moving the lumber support portion of the backrest forwardly by being seated and a state in which the lumber support portion of the backrest is not moved forwardly even when being seated. The invention will be able to be grasped further precisely through an explanation of a specific example described below.

BRIEF DESCRIPTION OF THE DRAWINGS

FIG. 7A is a partial perspective view of a base, FIG. 7B is a disassembled perspective view of a member constituting a first link mechanism, and FIG. 7C is a sectional view taken along a line VIIC-VIIC of FIG. 5 in a state of attaching a seat.

FIG. 13A is a sectional view taken along a line XIIIA-XIIIA of FIG. 11,

FIG. 13B is a sectional view taken along a line XIIIB-XIIIB of FIG. 11, FIG. 13C is a sectional view taken along a line XIIIC-XIIIC of FIG. 11, and FIG. 13D is a sectional view taken along a line D-D of FIG. 13C.

FIG. 26A is a side view of a chair according to a fourth embodiment, FIG. 26B is a partially enlarged view of FIG. 26A, and FIG. 26C is a partial sectional view of FIG. 26A.

DESCRIPTION OF REFERENCE NUMERALS AND SIGNS

Figure 1:
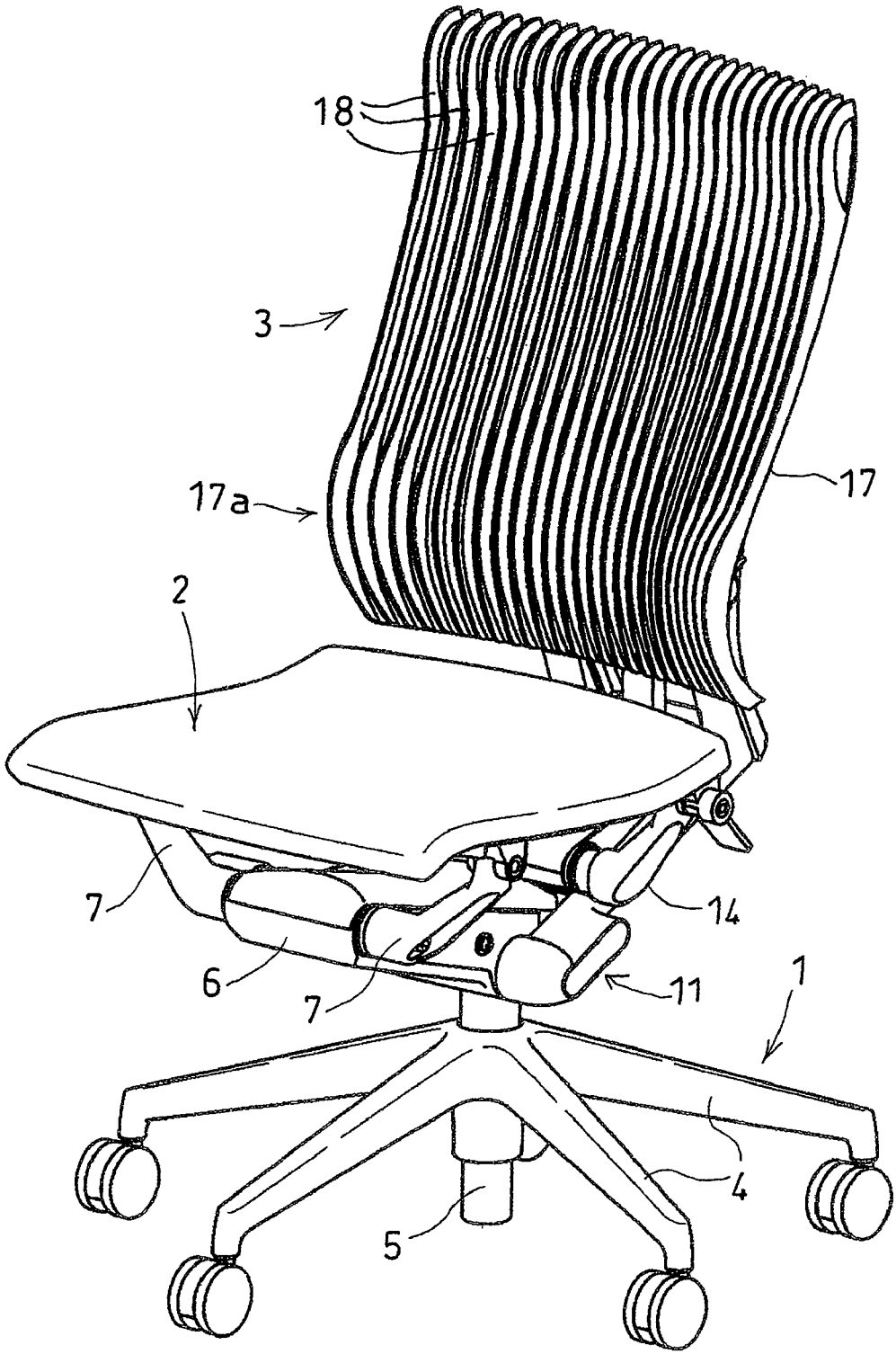
FIG. 1 is a total perspective view of a chair according to a first embodiment.
Figures 2A, 2B:
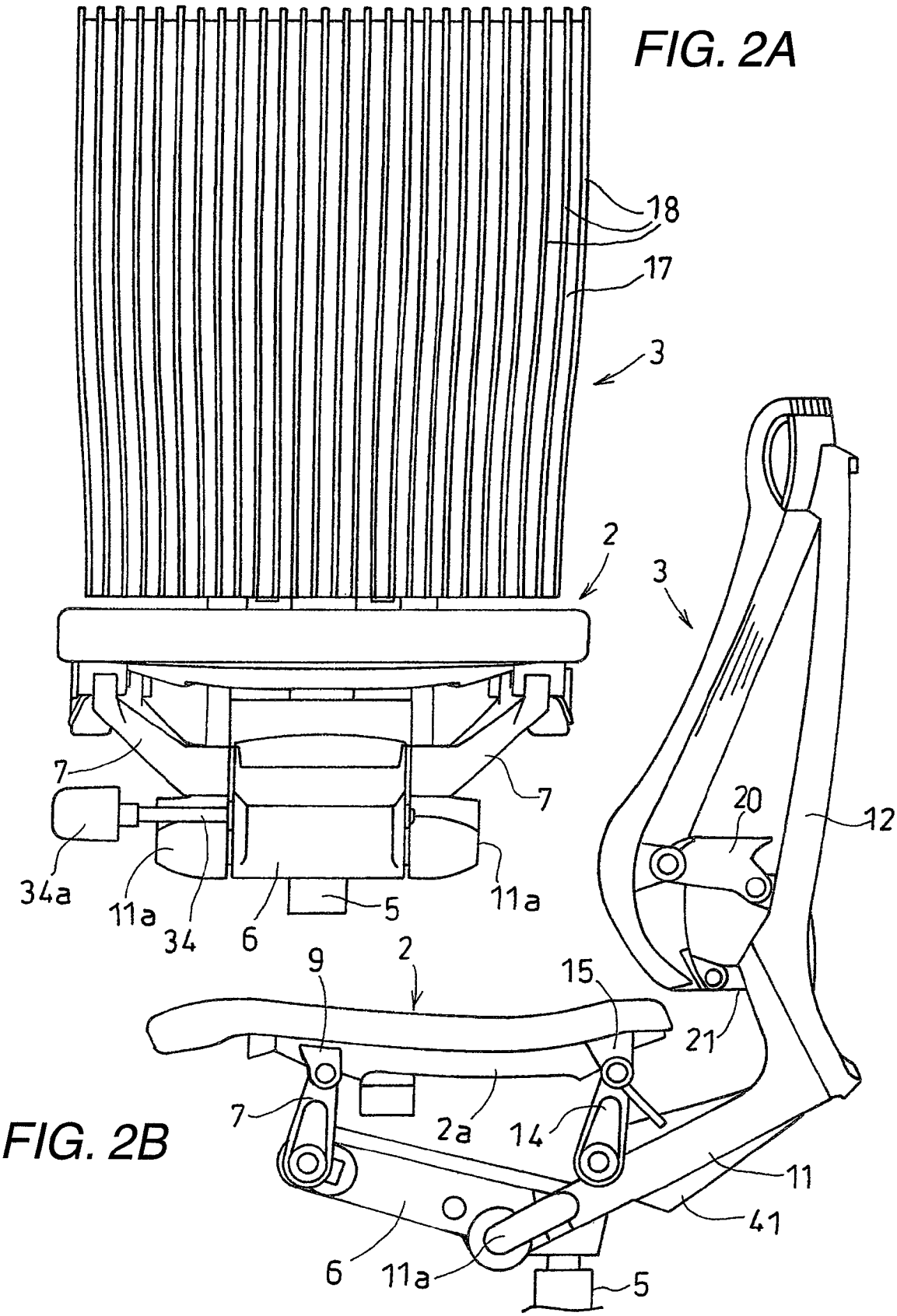
FIG. 2A is a front view of a chair.
FIG. 2B is a side view of the chair.
Figure 3:
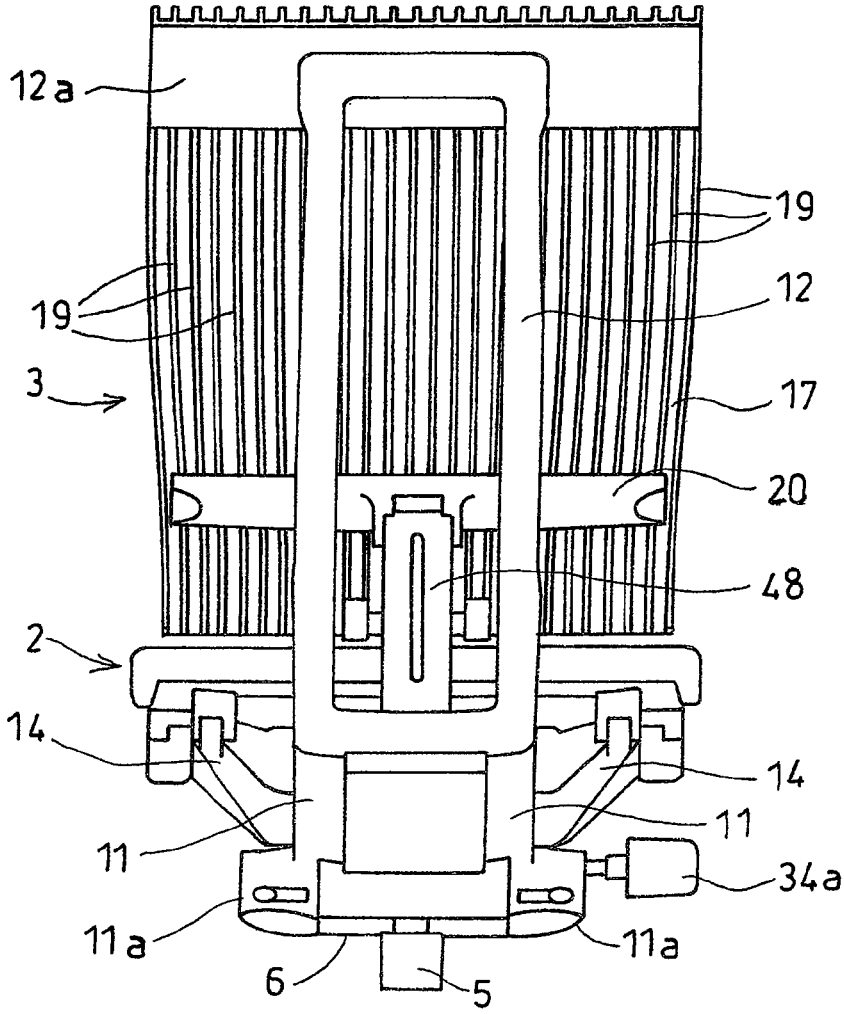
FIG. 3 is a rear view of a chair.
Figure 4:
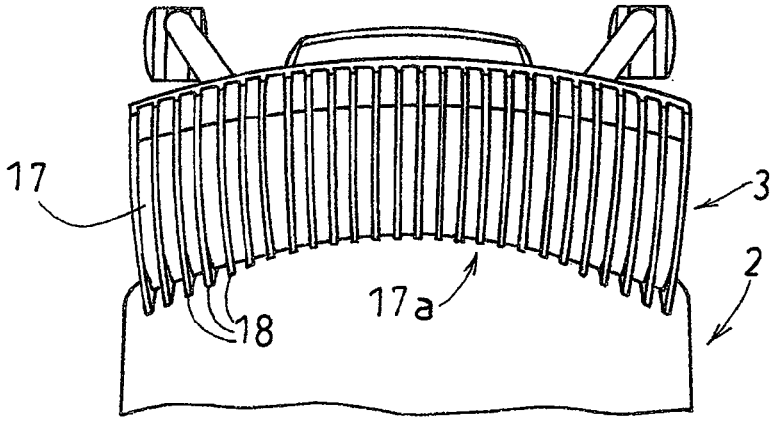
FIG. 4 is a partial plane view of a chair.

1 leg
2 seat
3 backrest
6 base
7 front support link
8 first support shaft
11 rocking frame constituting a portion of back support frame
12 back frame constituting a portion of back support frame
13 second support shaft
17 back plate
18, 19 ribs of back plate
20 fifth cooperatively moving link
21 fourth cooperatively moving link
31 rocking spring
36 first returning spring
41 receiving box
42 drive shaft
43 first cooperatively moving link
46 second cooperatively moving link
48 third cooperatively moving
49 second returning spring

BEST MODE FOR CARRYING OUT THE INVENTION

Next, an embodiment of the invention will be explained in reference to the drawings. The embodiment is applied to a revolving chair for office use or the like. First, a first embodiment will be explained in reference to FIG. 1 through FIG. 23.

(1)-1. Outline of First Embodiment

First, an outline of a chair will be explained mainly in reference to FIG. 1 through FIG. 7. The chair includes the leg 1 and the seat 2 and the backrest 3. The leg 1 includes a group of branch feet 4 extended in a horizontal shape and a leg stay (gas cylinder) 5, and an upper end of the leg stay 5 is attached with the base 6 made by a metal plate opened upwardly. As shown by, for example, FIG. 5 and FIG. 7C, the seat 2 includes a seat inner shell (seat plate) 2*a* made of a resin and a cushion 2*b* expanded over an upper face thereof.

As is clearly shown in FIG. 7C, a front side portion of the seat 2 is connected to the base 6 by way of left and right front links 7 and a left/right transversely prolonged first support shaft 8. A front portion of the seat inner shell 2*a* is formed with left and right pairs of front brackets 9 for squeezing the front support links 7 from both left and right sides thereof, and the front bracket 9 and the front support link 7 are connected relatively pivotably by a front pin 10. The seat 2 is gradually recessed in an upward concave shape in a front view thereof.

Figure 11:
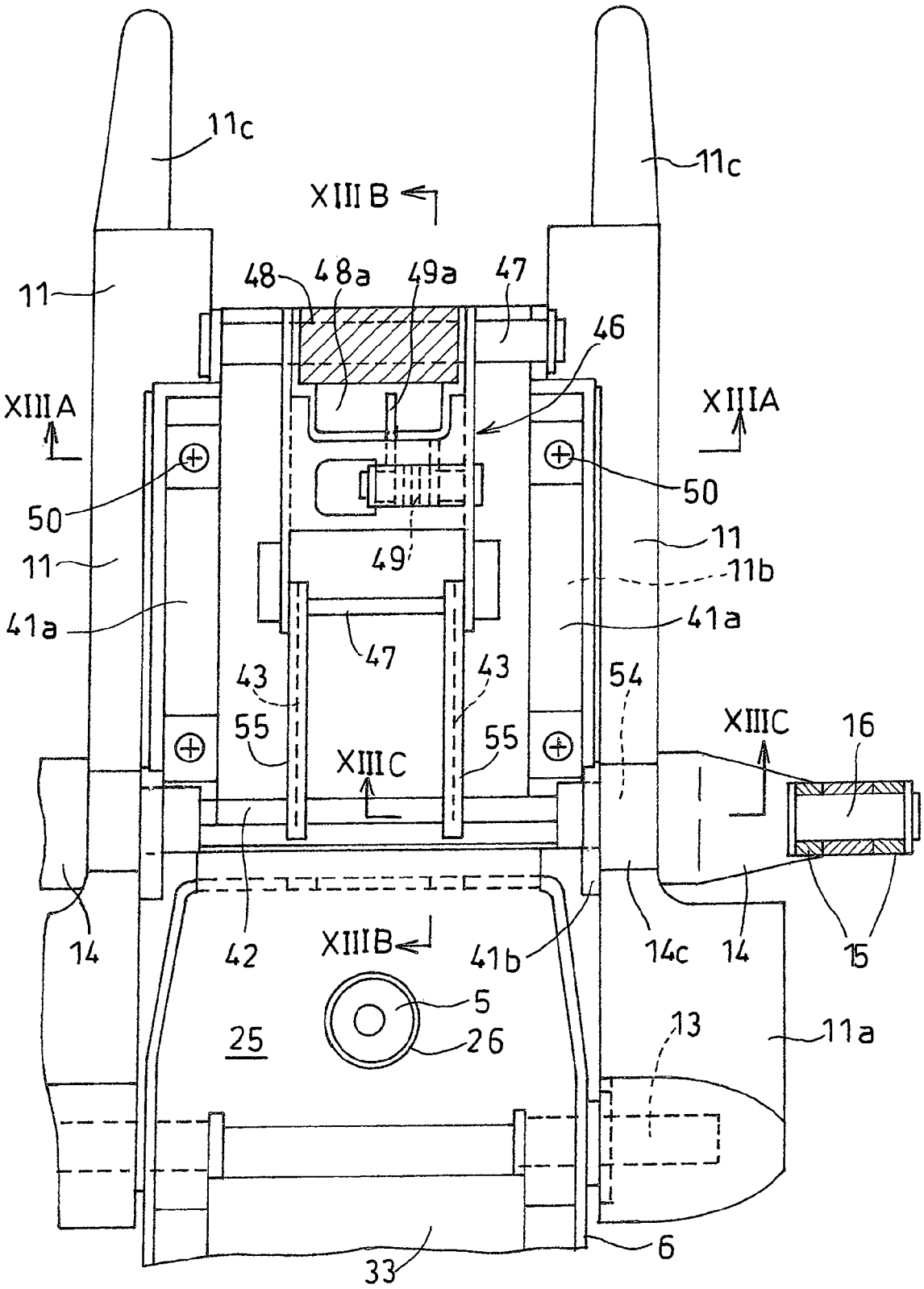
FIG. 11 is a plane sectional view centering on a member constituting cooperatively moving means.
Figure 12:
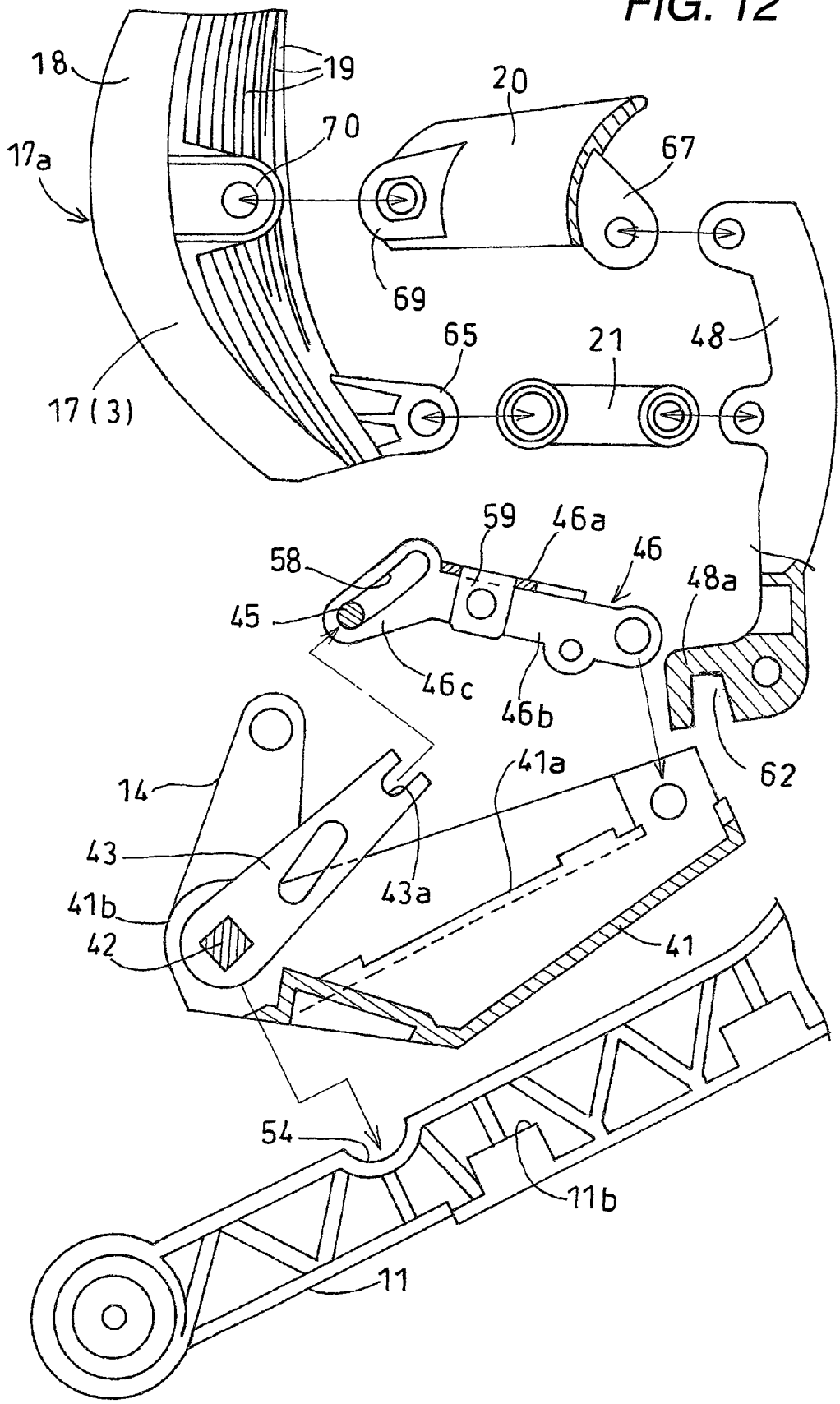
FIG. 12 is a partially broken disassembled perspective view centering on a member constituting cooperatively moving means.
Figure 15:
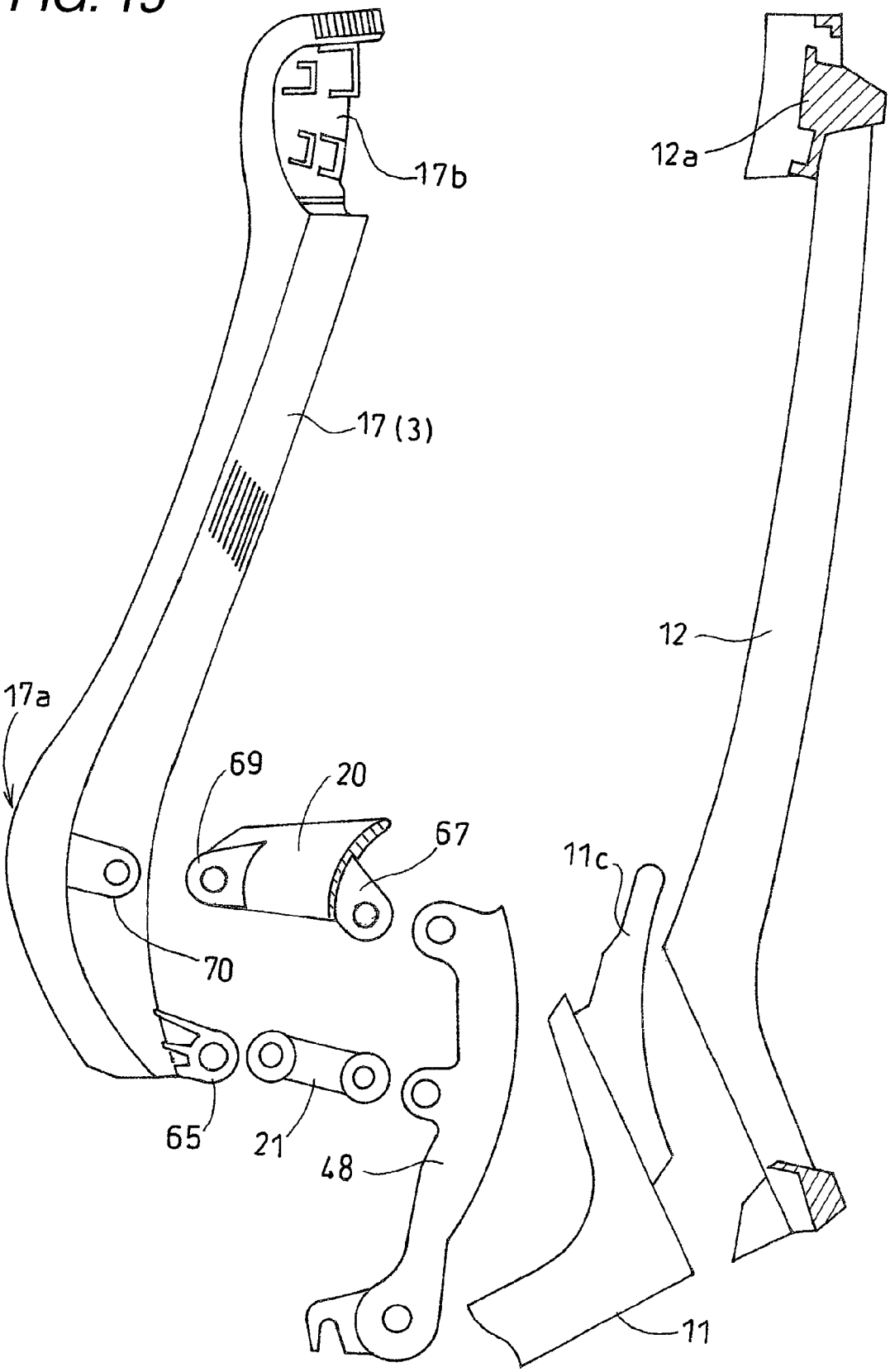
FIG. 15 is a disassembled side view showing a structure of attaching a backrest.
Figure 16:
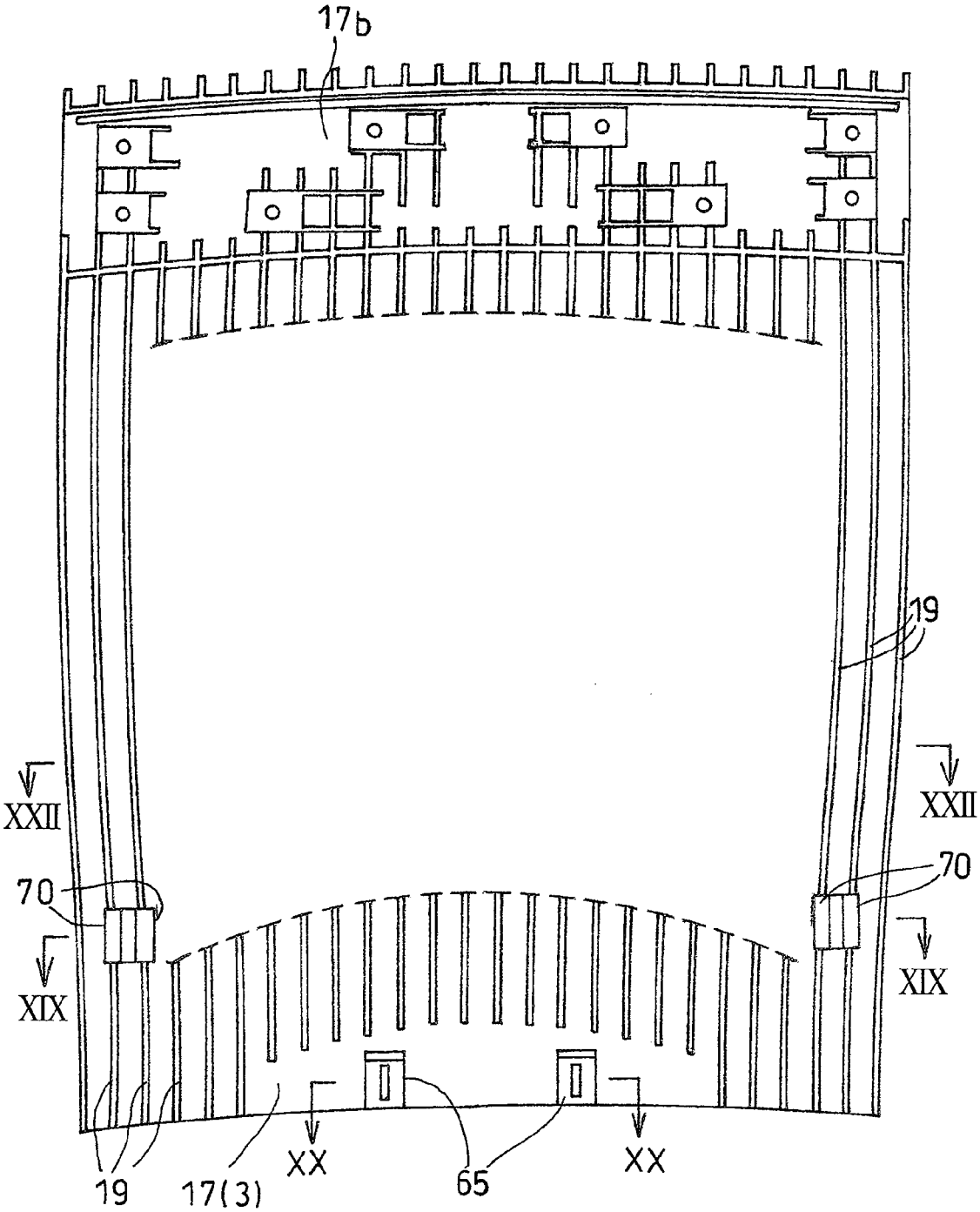
FIG. 16 is a rear view of a backrest.
Figure 17:
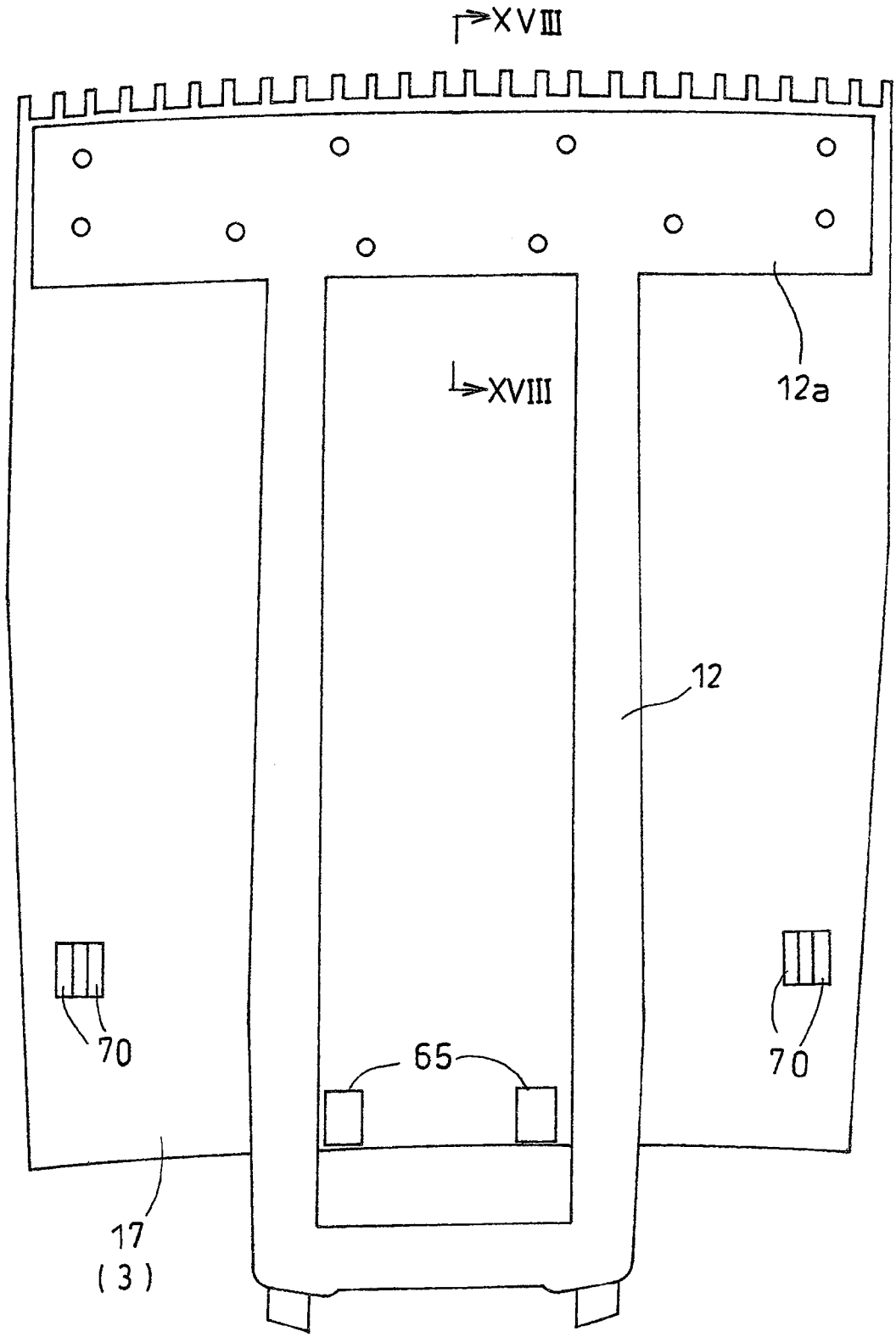
FIG. 17 is a partially omitted rear view in a state of attaching a backrest to a back support frame.

Both left and right sides of the base 6 are arranged with a pair of left and right rocking frames 11 in a rearwardly inclined attitude in a side view thereof and extended to a rear side of the base 6, and rear ends of the left and right rocking frames 11 are fixed with the back frame 12 substantially in a rectangular shape in a rear view thereof. In this case, as shown by FIG. 11 and FIG. 15, a rear end of the rocking frame 11 is provided with a boss portion 11*c* and the boss portion 11*c* is fitted to a hole (not illustrated) provided at the back frame 12.

According to the embodiment, by the rocking frame 11 and the back frame 12, a back support frame described in claims is constituted. Further, the rocking frame 11 and the back frame 12 can also be constituted by an integral structure, further, the back frame 12 can also be referred to as a back stay.

The rocking frame 11 is connected to a rear portion of the base 6 by a second support shaft 13 to be inclined rearwardly centering on a front end portion thereof. Further, a rear portion of the seat 2 and the rocking frames 11 are connected relatively pivotably by way of a pair of left and right rear support links 14. In a neutral state in which a person is not seated, the front support link 7 and the rear support link 14 are in a slightly rearwardly inclined attitude in a side view thereof, and therefore, when a person is seated, the links 7 and 14 are rearwardly inclined, in accordance therewith, the seat 2 is moved back while moving down without hardly changing the attitude in the side view (or, parallelly moved in a skewed rear direction).

A rear portion of the seat inner shell 2*a* is integrally formed with a pair of left and right rear brackets 15 for squeezing the rear support links 14 from left and right sides thereof, and the rear brackets 15 and the rear support links 14 are connected by left/right longitudinal pins 16. The front support link 7 and the rear support link 14 constitute a kind of a parallel link mechanism and a first link mechanism described in claims is constituted by the front support link 7 and the rear support link 14. A relationship between the rear support link 14 and the rocking frame 11 will be described later.

The backrest 3 is constituted only by a back plate 17 having a flexibility and made of a resin. Therefore, according to the embodiment, the backrest 3 and the back plate 17 are defined to be the same. A front face and a rear face of the back plate 17 are formed with numbers of vertically prolonged ribs 18 and 19 substantially at equal intervals (details thereof will be described later). The back plate 17 is gradually bent in a forwardly recessed shape in a plane view thereof both at respective upper and lower portions thereof. In an unseated state, a lower end of the back plate 17 is disposed proximately to the seat 2, further, the lower portion of the back plate 17 constitutes a lumber support portion 17*a* bent by a gradual radius of curvature in a forwardly projected shape in a side view thereof.

The back plate 17 is undetachably attached to the back frame 12 at an upper end portion thereof, on the other hand, an apex portion of the lumber support portion 17*a* is connected to a fifth cooperatively moving link 20 constituting cooperatively moving means, a lower end portion of the lumber support portion 17*a* is connected to a fourth cooperatively moving link 21 constituting cooperatively moving means, and when the seat 2 is moved down and moved back, the lumber support portion 17*a* is considerably moved forwardly.

Figure 6:
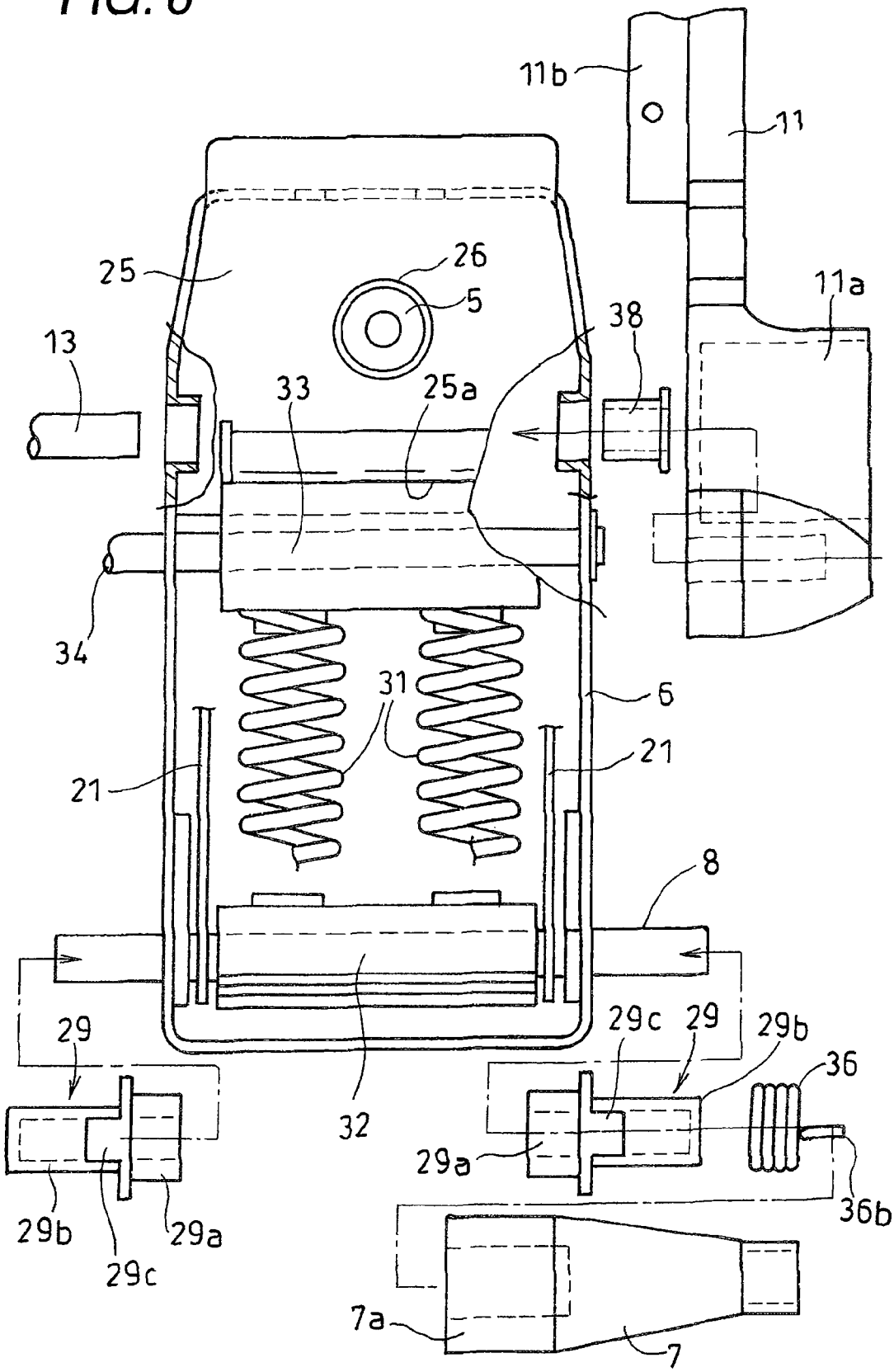
FIG. 6 is a disassembled plane view viewed from a line VI-VI of FIG. 5.

Further, notation 21 shown in FIG. 6 designates a member constituting a lock apparatus 21 for holding the seat 2 in an unmoved state even when seated. When used by a person having a habit of being seated thereon always deeply, it is preferable to hold the seat 2 to be unmoved by the lock apparatus 21. Details of respective portions will be explained as follows.

(1)-2. Details of Peripheral Portion of Base

Figure 5:
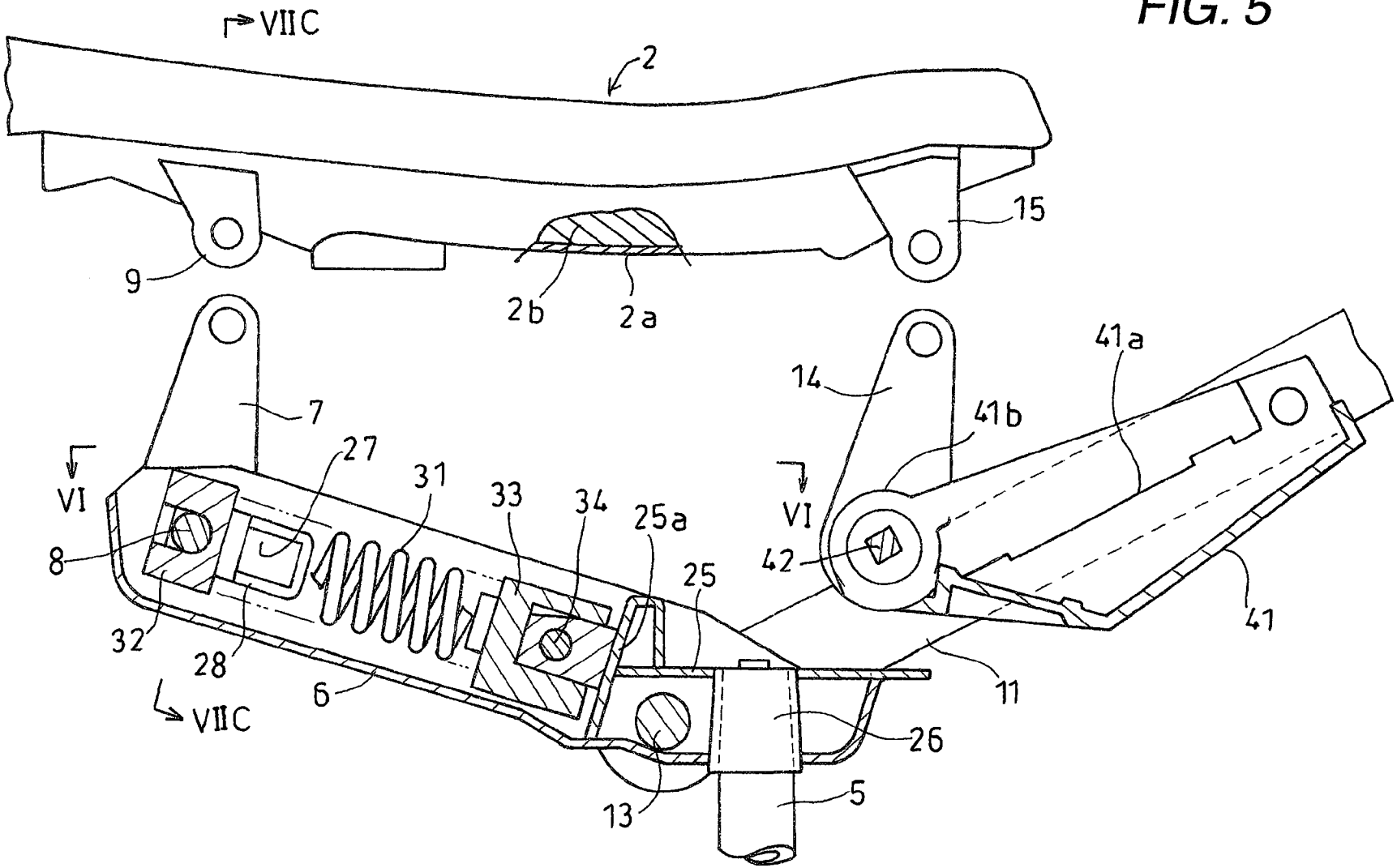
FIG. 5 is a partially broken disassembled view showing means for supporting a seat.

First, a constitution of a portion centering on the base 6 will be explained mainly in reference to FIG. 5 through FIG. 7. As described above, the base 6 is formed by a shape of a box opened upwardly, an inner portion and a rear portion thereof is fixedly attached with a reinforcement bracket 25, and an upper end of the leg stay 5 is fittedly attached to a bush 26 (refer to FIG. 5) fixedly attached to the base 6 and the reinforcement bracket 25.

Front end portions of left and right side plates of the base 6 are opened with long holes 27 in a square shape in a side view thereof fitted with the first support shaft 8 slidably substantially in a front and rear direction. The long hole 27 is fitted with a bush 28 made of a resin. The bush 28 is fitted with a bearing member 29 from an outer side and unrotatably and slidably, the left and right bearing members 29 are fitted with the first support shaft 8, and the first support shaft 8 is fixed to the bearing member 29 by a screw 30. The bearing member 29 is made of a metal or made of a resin.

An inner portion of the base 6 is arranged with 2 pieces of left and right rocking springs (compression coil springs) 31 in an attitude of being extended in a front and rear direction, the shaft 8 is fitted with a front spring receive 32 from a rear side, on the other hand, the reinforcement bracket 25 is formed with a receive wall 25*a* for supporting a rear spring receive 33. Although details will be omitted since hardly related to the invention, the rear spring receive 33 is constituted by a fixed portion and a movable portion, when a handle 34*a* (refer to FIG. 2A) provided at an operating rod 34 is operated to rotate, the movable portion is moved forwardly and rearwardly and an initial elastic force of the rocking spring 31 is changed.

The front support link 7 includes the cylindrical portion 7*a* in a horizontal shape, and the cylindrical portion 7*a* is fitted with the bearing member 29 described above. As shown by FIG. 7B, the bearing member 29 includes a square portion 29*a* unrotatably and slidably fitted to the bush 28, and a small diameter cylindrical portion 29*b* rotatably brought into the cylindrical portion 7*a* of the front support link 7. Further, a root portion of the small diameter cylindrical portion 29*b* is formed with a pair of stopper portions 29*c* extended in outer directions in a state of being spaced apart from the small diameter cylindrical portion 29*b*.

The pair of stopper portions 29*c* are arranged on both sides interposing an axis center, and the cylindrical portion 7*a* of the front support link 7 is formed with circular arc shape grooves 35 (refer to FIG. 7C) for permitting the stopper portions 29*c* to pivot by some degrees of angles (for example, about 50 through 55 degrees). Further, the small diameter cylindrical portion 29*b* of the bearing member 29 is fitted with the first returning spring 36. The first returning spring 36 is a torsional spring, one end 36*a* extended in a radial direction is brought into contact with the one stopper portion 29*c*, and other end 36*b* extended in the axis center direction is fitted to a stopper hole 37 formed at the cylindrical portion 7*a* of the front support link 7. The stopper hole 37 is formed in a nonring-like shape such that the other end portion 36*b* of the first returning spring 36 is not moved in a circumferential direction.

When a person is seated, the front support link 7 is inclined rearward against an elastic force of the first returning spring 36, and when a person leaves the chair, the front support link 7 is recovered to an original state by the elastic force of the first returning spring 36. When the first returning spring 36 is included in the front support link 7 as in the embodiment, there is achieved an advantage of making the chair compact and facilitating to integrate the chair. Naturally, a location of arranging and a kind of spring means for returning the front support link 7 and the seat 2 to a neutral state can be selected arbitrarily as necessary. For example, a compression coil spring can also be arranged between a lower face of the seat 2 and the base 6.

The support links 7 and 14 are extended upwardly by an attitude of being inclined in a skewed outer direction in a front view thereof. This is for supporting the seat 2 in a stable state since a left and right width dimension of the base 6 is considerably smaller than a left and right width dimension of the seat 2. The seat 2 is supported by the support links 7 and 14 at portions thereof proximate to both left and right ends, and therefore, when a person is seated, the seat 2 is permitted to deform so as to bend in a downwardly recessed shape. The seat 2 is provided with cushioning performance by the bending deformation.

For example, as shown by FIG. 6, the pivoting frame 11 is fitted to the side plate of the base 6 through the bush 38. The second support shaft 13 is undetachably held in the rocking frame 11 by a screw or a snap ring (not illustrated). A front end portion of the pivoting frame 11 is formed with a front/rear longitudinal expanded portion 11*a* opened outwardly. The expanded portion 11*a* is for attaching an armrest apparatus (not illustrated). Further, the pivoting frame 11 is made of a metal as in an aluminum diecast product. Naturally, a seat metal product or a molded resin product can also be adopted. Further, the left and right rocking frames 11 can also be connected integrally at rear ends thereof.

(1)-3. Details of Cooperatively Moving Means (Part 1)

Next, details of cooperatively moving means will be explained. Firstly, substantially a lower half portion of cooperatively moving means will be explained centering on FIG. 8 through FIG. 14. For example, as shown by FIG. 8, cooperatively moving means of the embodiment includes the receive box (receiving member) 41 made of a metal opened upwardly, a drive shaft 42 in a square shape unrotatably fitted to the left and right rear support links 14, a pair of left and right first cooperatively moving links 43 relatively unrotatably fitted to the drive shaft 42, a second cooperatively moving link 46 connected to the first cooperatively moving link 43 by way of a first pin 45, a third cooperatively moving link 48 connected to the second cooperatively moving link 46 by way of a second pin 47, the fourth cooperatively moving link 21 connected relatively pivotably to an upper/lower middle portion of the third cooperatively moving link 48, and the fifth cooperatively moving link 20 connected relatively pivotably to an upper end portion of the third cooperatively moving link 48.

The fourth cooperatively moving link 21 and the fifth cooperatively moving link 20 are described above. According to the embodiment, a cooperatively moving link mechanism described in claims is constituted by the first through the fifth cooperatively moving links.

The second cooperatively moving link 46 is made by a metal plate and includes a ceiling plate 46*a* and left and right plates 46*b*, and a lower side of the ceiling plate 46 is arranged with the second returning spring 49. Also the second returning spring 49 constitutes a portion of cooperatively moving means. Details of respective constituent members will be explained as follows.

Figure 8:
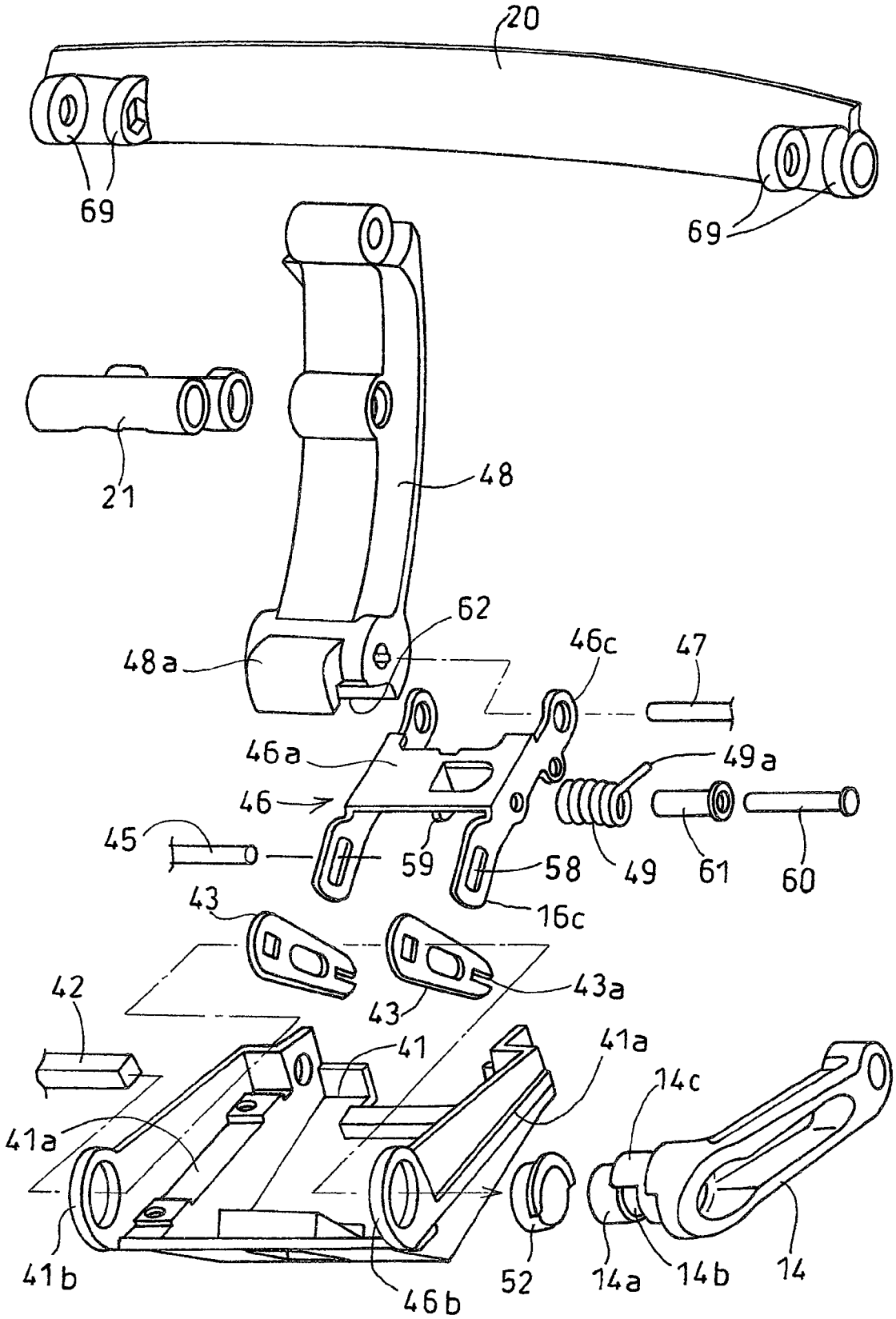
FIG. 8 is a disassembled perspective view of a member constituting cooperatively moving means.

As shown by, for example, FIG. 8 and FIG. 13A, the receive box 41 is constituted by a shape of a stepped difference shape in a front sectional view thereof by making left and right expanded portions 41*b* higher, and the left and right expanded portions 41*a* are fixed to an inwardly expanded portion 11*b* of the rocking frame 11 by a screw 50. Further, front end portions of left and right side plates constituting the receive box 41 are constituted by bearing portions 41*b* opened with round holes, and the small diameter cylindrical portion 14*a* of the rear support link 14 is fitted to the bearing portion 41*b* pivotably rotatably by way of a bush 52.

Although the rear support link 14 is similar to the front support link 7 in an outlook thereof, the rear support link 14 is provided with a particular structure as described below. First, as clearly shown in FIG. 13D, the rear support link 14 is relatively unrotatably fitted with the drive shaft 42 mentioned above, and the drive shaft 42 is held by the rear support link 14 undetachably by a screw 53. Next, the rear support link 14 includes an overlapping portion 14*b* overlapping an upwardly directed recessed portion 54 in a circular arc shape formed at the rocking frame 11, and the overlapping portion 14*b* is formed with a stopper portion 14*c* for restricting a pivoting range by being brought into contact with the rocking frame 11.

Next, the first cooperatively moving link 43 will be explained. A front end portion of the first cooperatively moving link 43 is formed with a cut open groove 43*a* fitted to the first cooperatively moving pin 45. Further, one face of the first cooperatively moving link 43 is overlapped with a protecting member 55 made of a resin. As shown by, for example, FIG. 10A, the protecting member 55 covers the first cooperatively moving link 41, and a front end portion thereof is constituted by a bifurcated shape in correspondence with the cut open groove 43*a* of the first cooperatively moving link 41. Therefore, when the first cooperatively moving link 41 and the second cooperatively moving link 46 are cooperatively pivoted, a metal sound is not generated.

The first cooperatively moving link 41 is opened with a square hole fitted to the drive shaft 42, as shown by FIG. 14B, the protecting member 55 is formed with a downwardly directed groove 56 fitted to the drive shaft 42 from an upper side. Therefore, the protecting member 55 is easy to be attached and detached. Further, it is preferable to fix the first cooperatively moving link 41 to the drive shaft 42 to be unable to shift therefrom by welding or the like.

(1)-4. Details of Cooperatively Moving Means (Part 2)

Next, the second cooperatively moving link 46 will be explained. As can easily be understood from, for example, FIG. 11 and FIG. 13B, a rear end portion of the second cooperatively moving link 46 is connected to the receive box 41 by the support shaft 47. Further, the left and right side plates 46*b* constituting the second cooperatively moving link 46 includes forwardly directed extended portions 46*c* and the first pin 45 is slidably fitted to a long hole 58 formed at the forwardly directed extended portion 46*c*. Further, the long hole 58 is mounted with a bush 46*d* made of a resin in a bag-like shape (refer to, for example, FIG. 10B. Depending on the drawings, the bush 46*d* is omitted).

The first pin 45 is fitted with the cut open groove 43*a* of the first cooperatively moving link 43 as described above. When the first cooperatively moving link 43 is pivoted downwardly, the second cooperatively moving link 46 is pivoted centering on the support shaft 47 to move a front end portion thereof downwardly. Further, as can be understood from FIG. 13B, a pivoting range of the first pivoting link 43 is restricted by being brought into contact with a bottom face of the receive box 41.

Figure 9:
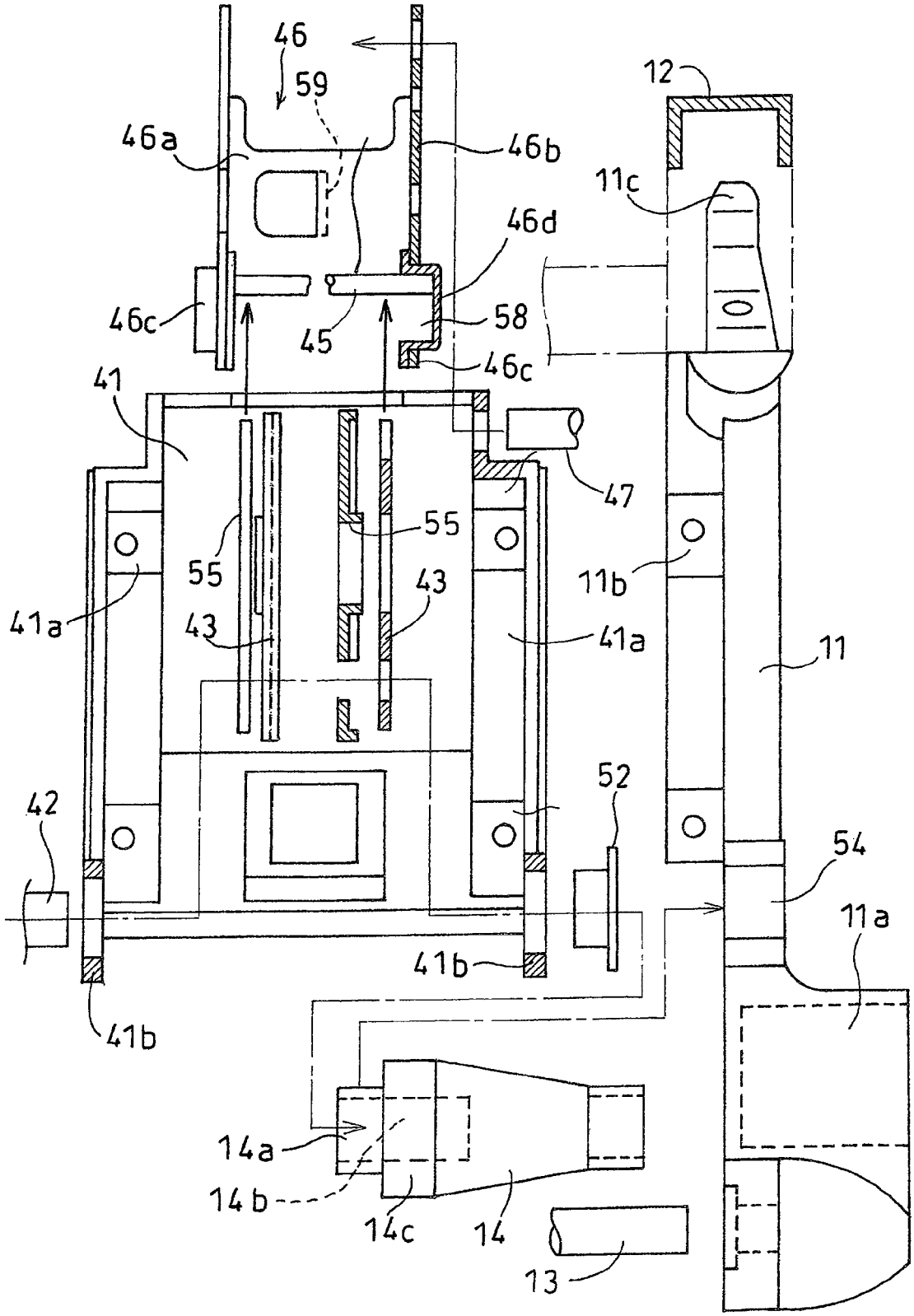
FIG. 9 is a partially broken disassembled view centering on a member constituting cooperatively moving means.
Figure 10A:
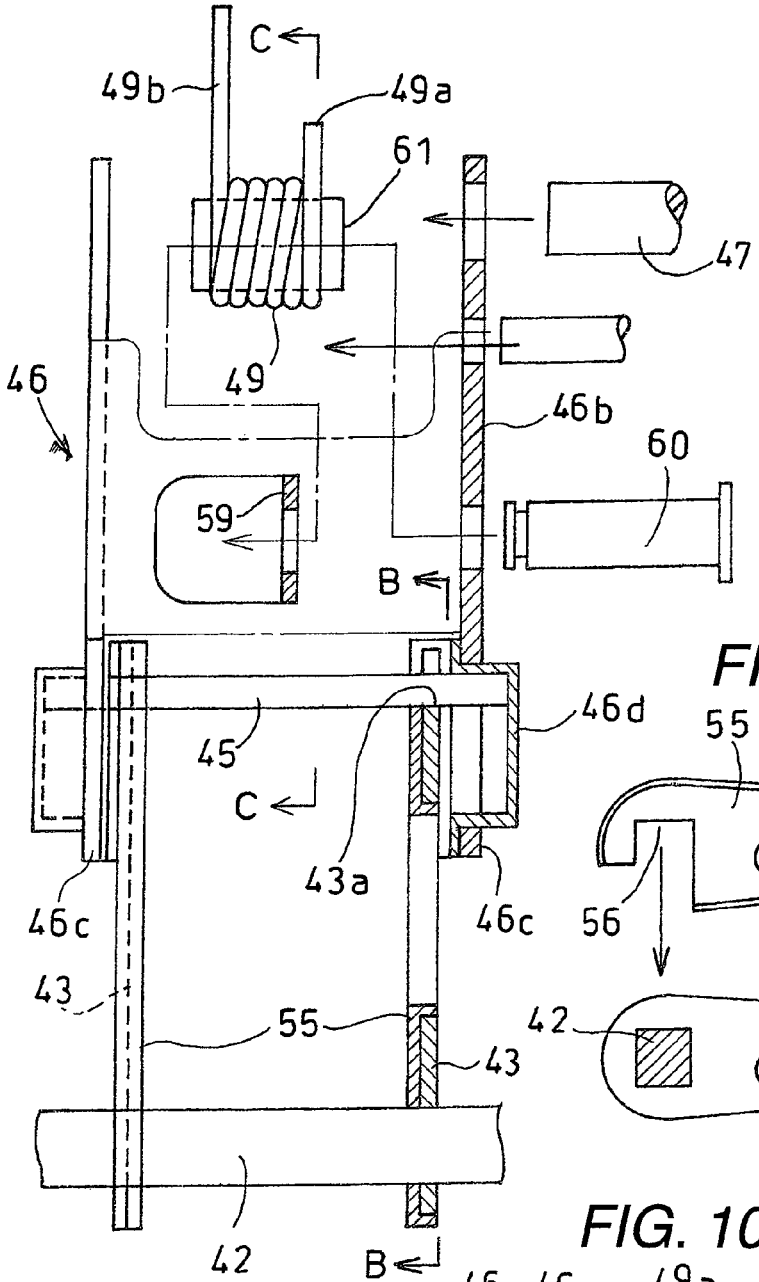
FIG. 10A is a partially broken disassembled plane view of a member constituting cooperatively moving means.
Figure 10B:
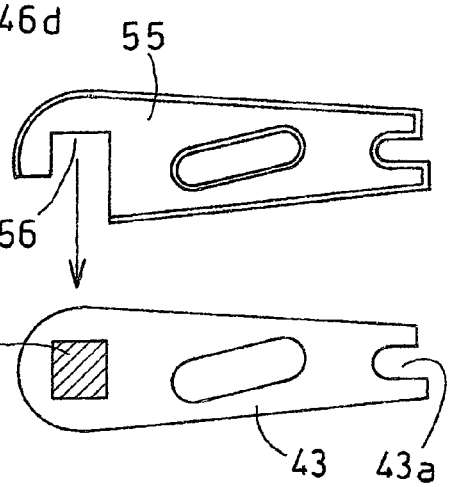
FIG. 10B is a disassembled sectional view taken along a line B-B of FIG. 10A.
Figure 10C:
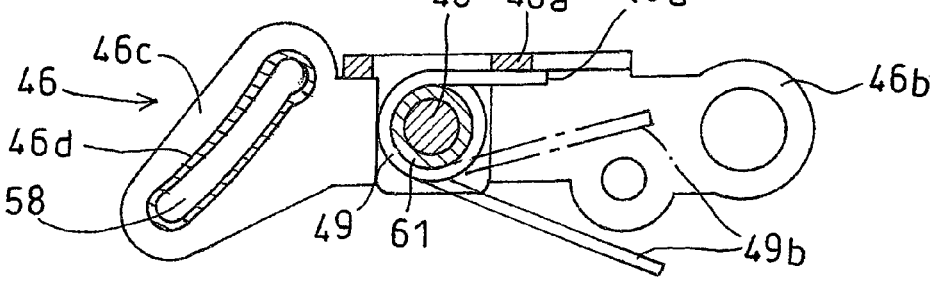
FIG. 10C is a sectional view taken along a line C-C of FIG. 10A in a state of integrating a spring.

The ceiling plate 46*a* of the second cooperatively moving link 46 is formed with a downward directed piece 59 by cutting to raise the ceiling plate 46*a*, a cylindrical member 61 is attached to the downward directed piece 59 and the one side plate 46*b* by way of a pin 60, and the cylindrical member 61 is fitted with the second returning pin 49 from an outer side (further, in FIG. 9 and FIG. 10A and FIG. 8, a position of a hole for forming the downwardly directed piece 59 is indicated inversely in a left and right direction). The second returning pin spring 49 is a torsional spring and both of one end portion 49*a* and other end portion 49*b* are extended in radial directions. Further, as is clearly shown in, for example, FIG. 13B, the one end portion 49*a* of the second returning spring 49 is brought into contact with the ceiling plate 46*a* of the second cooperatively moving link 46 from a lower side.

On the other hand, the third cooperatively moving link 48 is connected to the receive box 41 by the support shaft 57 mentioned above, further, a lower end of the third cooperatively moving link 48 is formed with a forwardly directed projected portion 48*a*, and the other end portion 49*b* of the second returning spring 49 is brought into contact with the forwardly directed projected portion 48*a* of the third cooperatively moving link 48. Further, as is clearly shown in FIG. 13B, the forwardly directed projected portion 48*a* of the third cooperatively moving link 48 is formed with a recessed portion 62 opened downwardly and the recessed portion 62 is fitted to a stopper pin 63 bridging the left and right side plates 46*b* of the second cooperatively moving link 46.

When the second cooperatively moving link 46 is pivoted downwardly, the third cooperatively moving link 48 is inclined forwardly centering on the support shaft 47. Further, since the forwardly directed projected portion 48*a* of the third cooperatively moving link 48 is only pressed by the second returning spring 49, the forwardly inclined third cooperatively moving link 48 can be inclined rearwardly (pivoted to return) by itself against an elasticity of the second returning spring 49. Further, it is also possible that the third cooperatively moving link 48 is not inclined forwardly and only the second cooperatively moving link 46 is pivoted downwardly.

Next, a portion of an upper portion of the cooperatively moving means related to the backrest 3 will be explained. An explanation will be given also in reference to drawing of FIG. 15 and drawings following FIG. 15. As described above, the cooperatively moving means includes the fourth cooperatively moving link 21 and the fifth cooperatively moving link 20. For example, as shown by FIG. 15, and FIG. 19, the fourth cooperatively moving link 21 connects the upper/lower middle portion of the third cooperatively moving link 48 and a lower end portion of the back plate 17.

Figure 14:
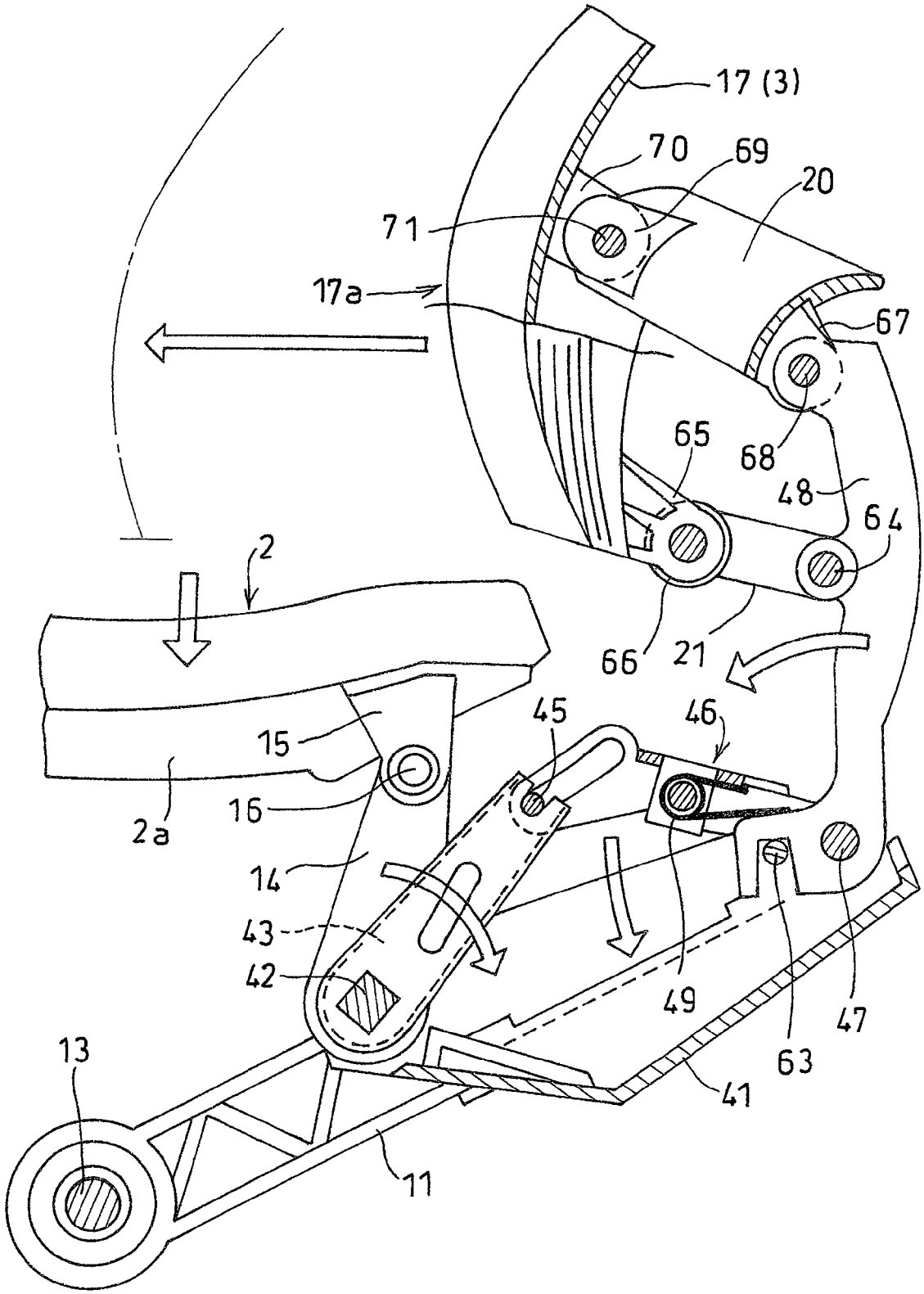
FIG. 14 is a vertical sectional view showing movement of cooperatively moving means.

The fourth cooperatively moving link 21 and the upper/lower middle portion of the third cooperatively moving link 48 are connected by a left/right longitudinal pin 64 (refer to FIG. 14). On the other hand, a lower end of a left/right middle portion of the back plate 17 is projected with a pair of left and right lower bearing portions 65 squeezing the fourth cooperatively moving link 21 from both left and right sides thereof, and the fourth cooperatively moving link 21 and the lower bearing portion 65 are connected by a left/right longitudinal pin 66 (refer to FIG. 14).

Figure 19:
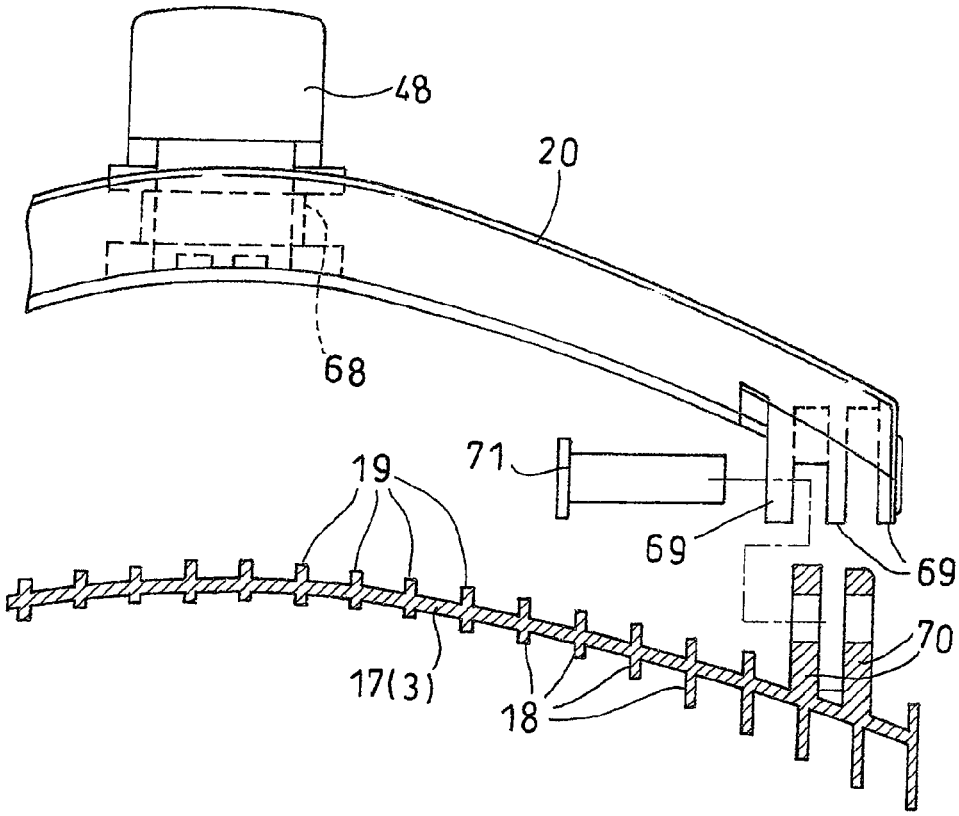
FIG. 19 is a disassembled plane sectional view taken along a line XIX-XIX of FIG. 16.

Although a left/right width dimension of the fourth cooperatively moving link 21 is small, as shown by FIG. 19, the fifth cooperatively moving link 20 is provided with a large left/right lengths slightly smaller than a left/right width dimension of the back plate 17, further, the fifth cooperatively moving link 20 is constituted by a shape warped in a bow-like shape in a forwardly directed recessed shape in a plane view thereof. Further, as shown by FIG. 14 and FIG. 15, a left/right middle portion of the fifth cooperatively moving link 20 is provided with a pair of left and right bearing brackets 67 and the bearing bracket 67 and an upper end portion of the third cooperatively moving link 48 are connected by a left/right longitudinal pin 68.

Further, whereas both left and right end portions of the fifth cooperatively moving link 20 each is formed with three sheets of bearing pieces 69 (in FIG. 8, only 2 sheets of bearing pieces 69 are displayed). Both left and right end portions of the lumber support portion 17*a* of the back plate 17 are projected with 2 sheets of upper bearing brackets 70 fitted to the bearing pieces 69 of the fifth cooperatively moving link 20, and the upper bearing brackets 70 and the bearing pieces 69 are connected by a left/right longitudinal pin 71.

The back plate 17 is connected in a state of being supported by both ends thereof by the fifth cooperatively moving link 20. Therefore, the lumber support portion 17*a* of the back plate 17 is permitted to deform so as to sink to a rear side in a plane view thereof by a body pressure of a seated person.

(1)-5. Back Plate

Next, a structure of the back plate 17 and an attaching structure of an upper portion thereof will be explained. As described above, the back plate 17 is fabricated by constituting a material by a rubber matter synthesis resin, and is provided with a flexibility by which the back plate 17 can be considerably bent to deform by the hand of a grown-up person at a condition of a single member thereof. In a state of the single member, a side view shape and a plane view shape can considerably be changed by grabbing the back plate 17 by the both hands of a person and exerting a force thereto. The flexibility to such a degree is provided.

Figure 20:
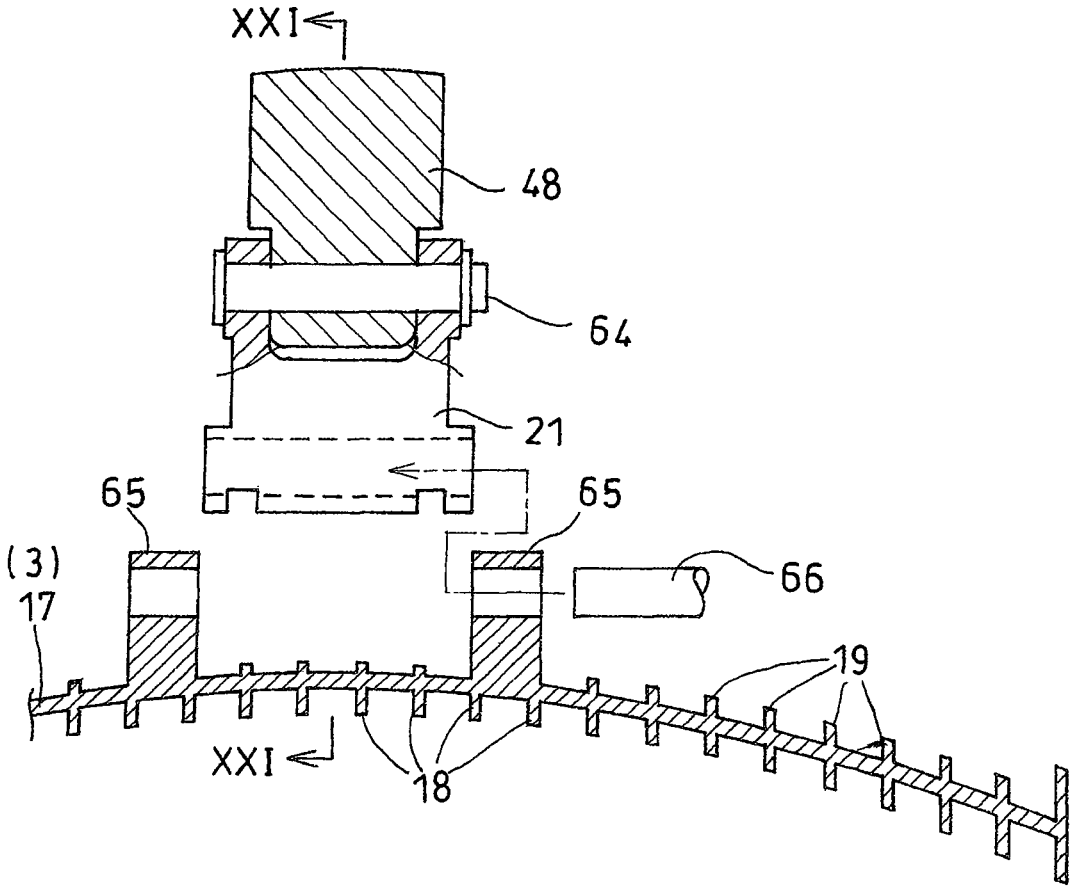
FIG. 20 is a disassembled plane sectional view taken along a line XX-XX of FIG. 16.
Figure 21:
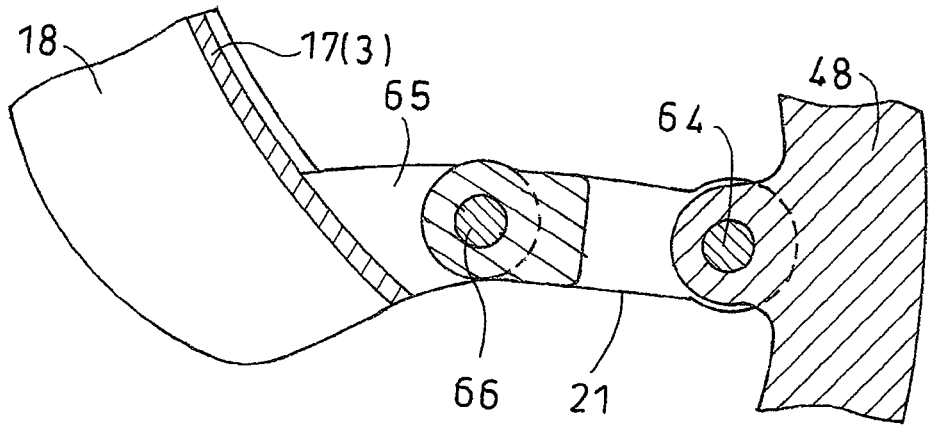
FIG. 21 is a sectional view taken along a line XXI-XXI of FIG. 20.
Figure 22:
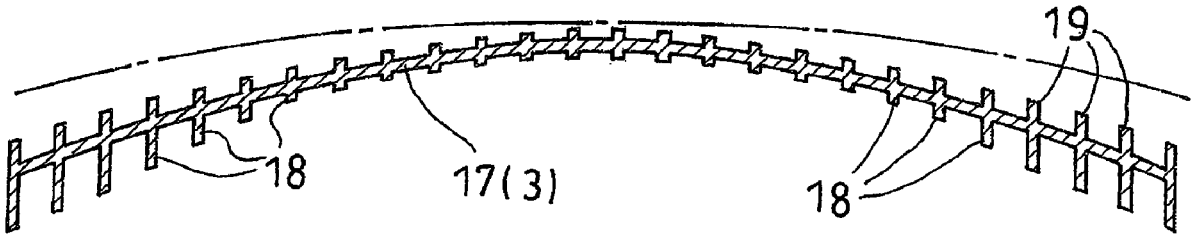
FIG. 22 is a sectional view taken along a line XXII-XXII of FIG. 16.

Further, the both front and rear faces of the back plate 17 are formed with numbers of the vertically prolonged ribs 18 and 19, for example, as can be understood from FIG. 20 and FIG. 22, the groups of the ribs 18 and 19 are set such that heights thereof are increased as proceeding from the left/right middle portion to the both left and right ends, further, as can be understood from FIG. 15, the group of the ribs 18 is set such that the height is increased at a vicinity of the apex portion of the lumber support portion 17*a*. Therefore, the lumber support portion 17*a* of the back plate 17 is brought into a state in which a side view thereof is not changed so much but a plane view thereof is easy to be deformed.

According to the embodiment, the front and rear ribs 18 and 19 are formed at the same positions in plane view (or in rear view) (therefore, the back plate 17 is further facilitated to deform in plane view). Further, the group of the ribs 18 of the front face and the group of the ribs 19 of the rear face are formed in a state of being substantially near to symmetrical in the front and rear direction. Naturally, the rib 18 of the front face and the rib 19 of the rear face can be formed by being shifted in a left and right direction.

In forming the ribs 18 and the front face, an interval of the ribs 18 is set to a small dimension of, for example, around 15 mm. Therefore, even when the body of a person is directly supported by the back plate 17, the person does not feel a strange feeling. Further, thicknesses of the ribs 18 and 19 are set to a dimension to a degree the same as that of a thickness of the back plate 17.

Figure 18:
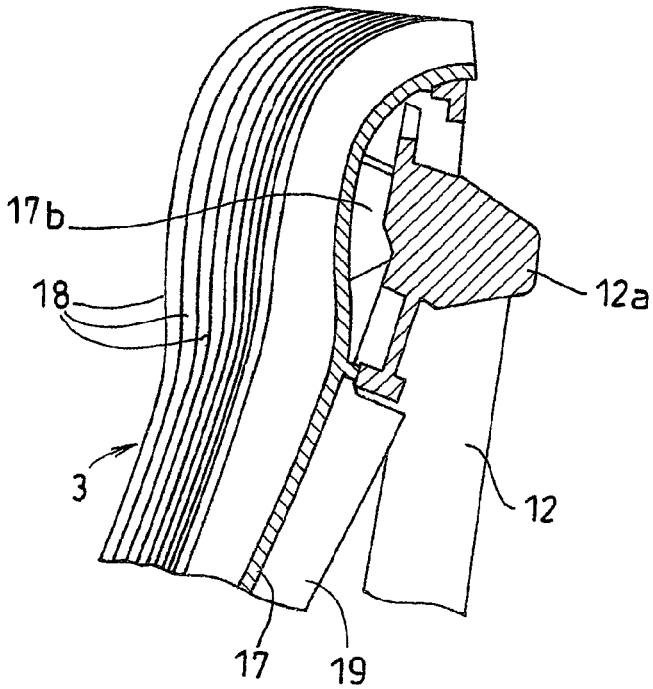
FIG. 18 is a sectional view taken along a line XVIII-XVIII of FIG. 17.

For example, as can easily be understood from FIG. 18, an upper portion of the back plate 17 is formed with an attaching portion 17*b* bent in a rearwardly directed recessed shape, and the upper portion 12*a* of the back frame 12 is fitted to the attaching portion 17*b* from a rear side. The attaching portion 17*b* of the back plate 17 and the upper portion 12*a* of the back frame 12 are held unseparably by, for example, screwing. The back plate 17 can also be attached to the upper portion 12*a* of the back frame 12 in a state of being able to be inclined centering on an upper portion thereof.

According to the embodiment, the upper portion 12*a* of the back frame 12 is extended to vicinities of left and right end portions of the back plate 17, and therefore, the upper portion of the back plate 17 is not deformed in plane view. The upper portion of the back plate 17 is supported by the back frame 12 substantially over a total length in a left and right direction because when the back plate is excessively deformed, a stability of the body is deteriorated and a comfort in seating is rather deteriorated.

Although there is a case in which a seated person adopts a motion of twisting the waist in a state of bringing the waist into contact with the backrest 3 (back plate 17), a portion of the back plate 17 downward from the middle portion is permitted to deform such that the left and right end portions are escaped to move to the rear side, and therefore, in twisting the waist and directing the upper half body transversely, the back plate 17 is easily deformed by following the motion of the person. Therefore, the invention is excellent in fitting performance. On the other hand, the upper portion of the back is supported by the upper portion of the back plate 17 that is not deformed, and therefore, the stability of the body is ensured.

(1)-6. Summary

Figure 23:
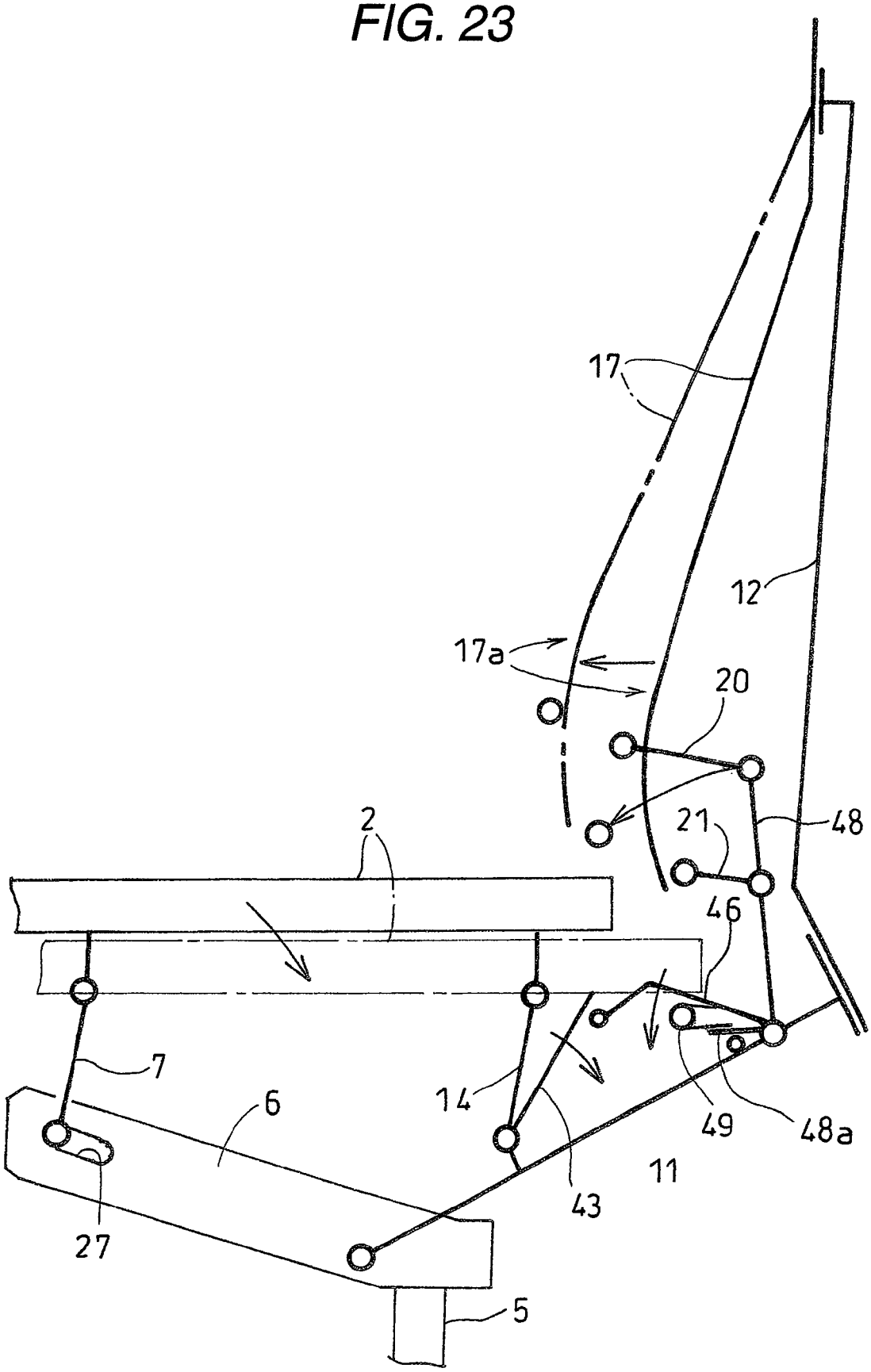
FIG. 23 is a skeleton structure view showing movement of a seat and a backrest.

FIG. 23 shows a total of movement of the chair mentioned above. That is, when a person is seated, the front and rear support links 7 and 14 are inclined rearwardly and the seat 2 is moved back while moving down. Further, by rotating the drive shaft 42 in cooperation with inclining the rear support link 14 rearwardly, the first cooperatively moving link 43 is inclined rearwardly, pivoting of the first cooperatively moving link 43 is transmitted to the third cooperatively moving link 48 by way of the second cooperatively moving link 46 and the second returning spring 49, and the third cooperatively moving link 48 is inclined forwardly. Thereby, the lumber support portion 17*a* of the back plate 17 is moved forwardly. According to the embodiment, a rearward moving dimension of the seat 2 is set to a forward moving dimension of the lumber support portion 17*a* by about 50 mm.

The back frame 12 is not inclined rearwardly by only making a person seated, and therefore, the upper end portion of the back plate 17 is held unmovably. Further, the lumber support portion 17*a* of the back plate 17 is made to be able to be moved forwardly by pivoting the fourth cooperatively moving link 21 and the fifth cooperatively moving link 20.

The lumber support portion 17*a* of the back plate 17 is moved forwardly by pivoting the back plate 17 centering on the upper end portion. Therefore, the lumber support portion 17*a* tends to increase the height while moving forwardly. Although in the neutral state in which the person is not seated, the lumber support portion 17*a* is disposed considerably on the lower side, when the person is seated, the seat 2 is moved downwardly and the lumber support portion 17*a* becomes higher while moving forward, thereby, the lumber support portion 17*a* is disposed at an optimum height of supporting contact to the lumber vertebra (particularly, third lumber vertebra) of the seated person.

The third cooperatively moving link 46 can be inclined rearwardly against an elastic force of the second returning spring 49, and therefore, it is permitted to shift the body rearwardly in a state of being seated shallowly, and move down and move back only the seat 2 without moving the back plate 17 forwardly by being seated deeply from the start. The point has already been described.

Meanwhile, in a rocking chair, when leaning on the backrest, there is frequently brought about a phenomenon of so-tospeak shirt turning up owing to a fact that whereas positions of the hip of a person and a seat relative to each other stay to be constant, the seat and the backrest tend to be separated from each other.

In contrast thereto, according to the embodiment, when a seated person leans on the back plate 17, the fourth cooperatively moving link 21 and the firth cooperatively moving link 20 tend to be pivoted downwardly in a side view, the back plate 17 tends to be extended downwardly, and therefore, the phenomenon of shirt turning up can be prevented and considerably restrained by preventing or restraining a relative distance of the seat 2 and the back plate 17 from being increased. This point is an advantage of the embodiment.

According to the embodiment, respective members constituting the cooperatively moving means are unitized to one by constituting an essential member by the receive box 41. Therefore, by previously integrating to unitize the members constituting the cooperatively moving means and fixing the receive box 41 to the rocking frame 11, the unitized cooperatively moving means (cooperatively moving apparatus) can be attached and detached. Therefore, the chair can easily be integrated and also movement of the respective cooperatively moving links becomes smooth. Also this point is a significant advantage of the embodiment.

(2). Second Embodiment

Figure 24:
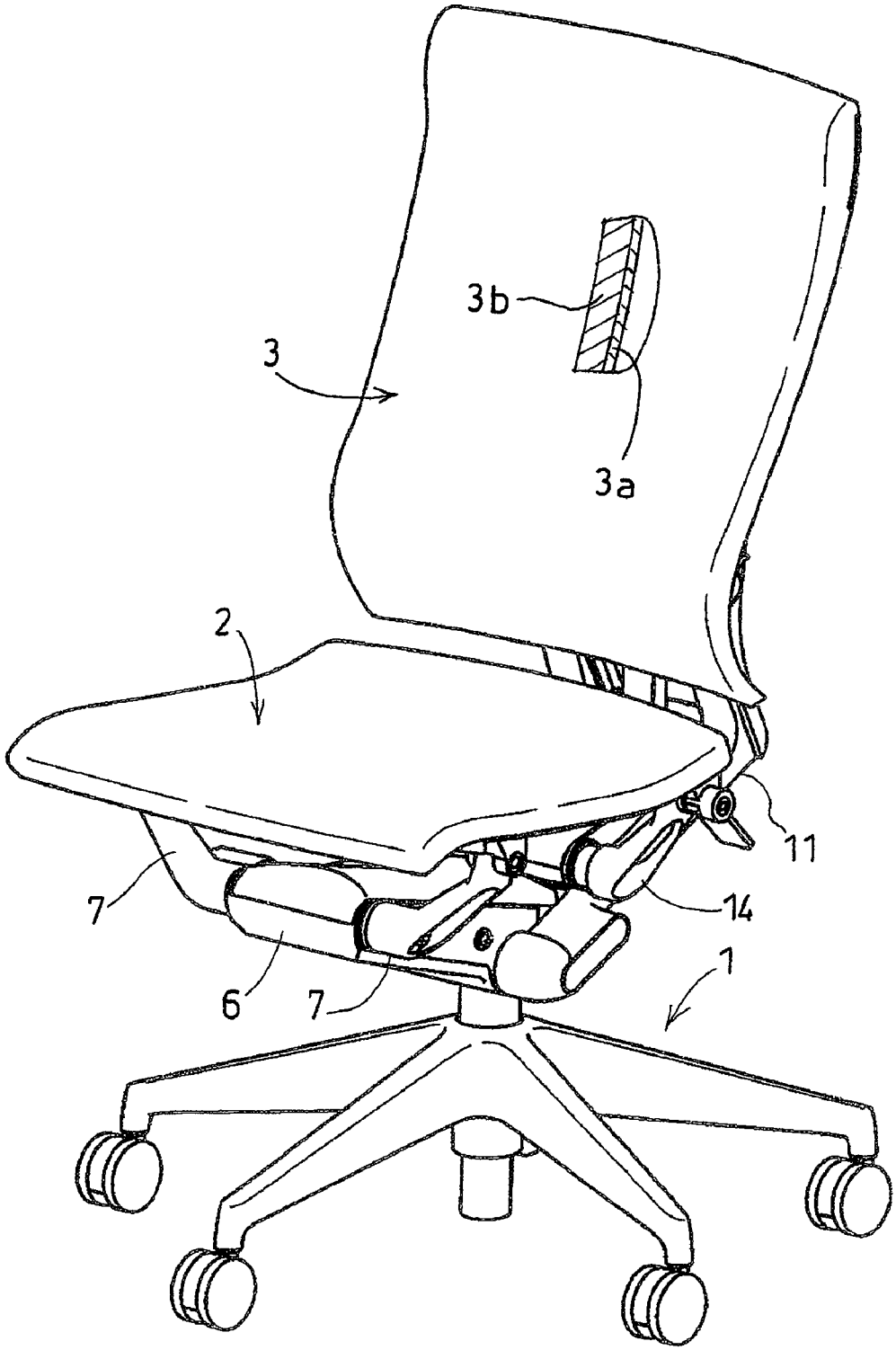
FIG. 24 is a total perspective view of a chair according to a second embodiment.

FIG. 24 shows an outlook of a second embodiment. The embodiment is a modified example of the first embodiment and a point of a difference from the first embodiment resides only in that the backrest 3 is constituted by the back inner shell 3*a* and the cushion member 3*b* expanded over a front face thereof made of a synthetic resin.

Although the back inner shell 3*a* can also be fabricated by resin including elastomer similar to the back plate 17 of the first embodiment, it is preferable to use a general purpose resin such as polypropylene in view of cost. As a method of providing a flexibility when the general purpose resin such as polypropylene is used for the back inner shell, it can be adopted, for example, to form a number of left/right transversely prolonged slits.

(3). Third Embodiment

Figure 25:
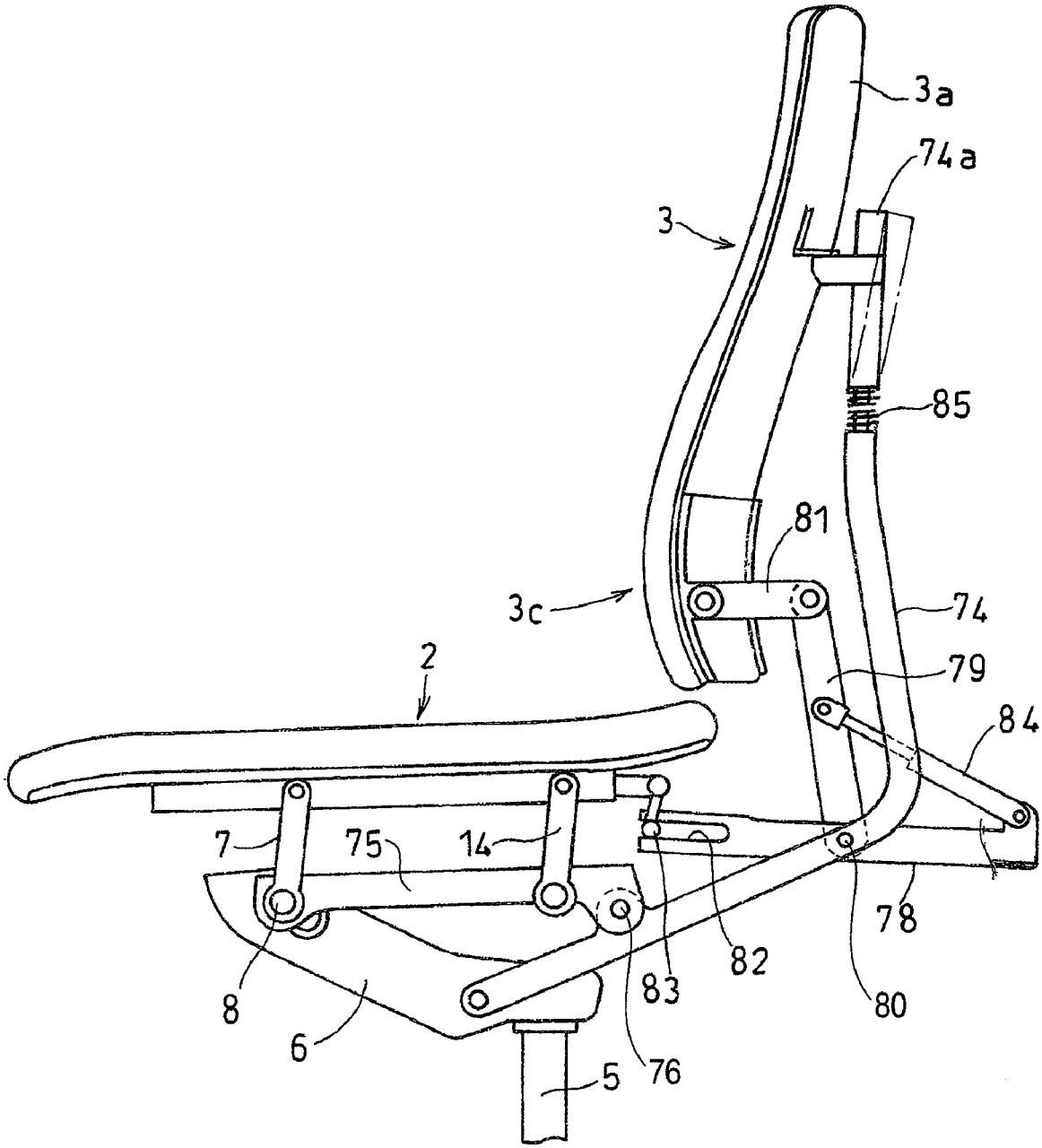
FIG. 25 is a side view of a chair according to a third embodiment.
Figure 27:
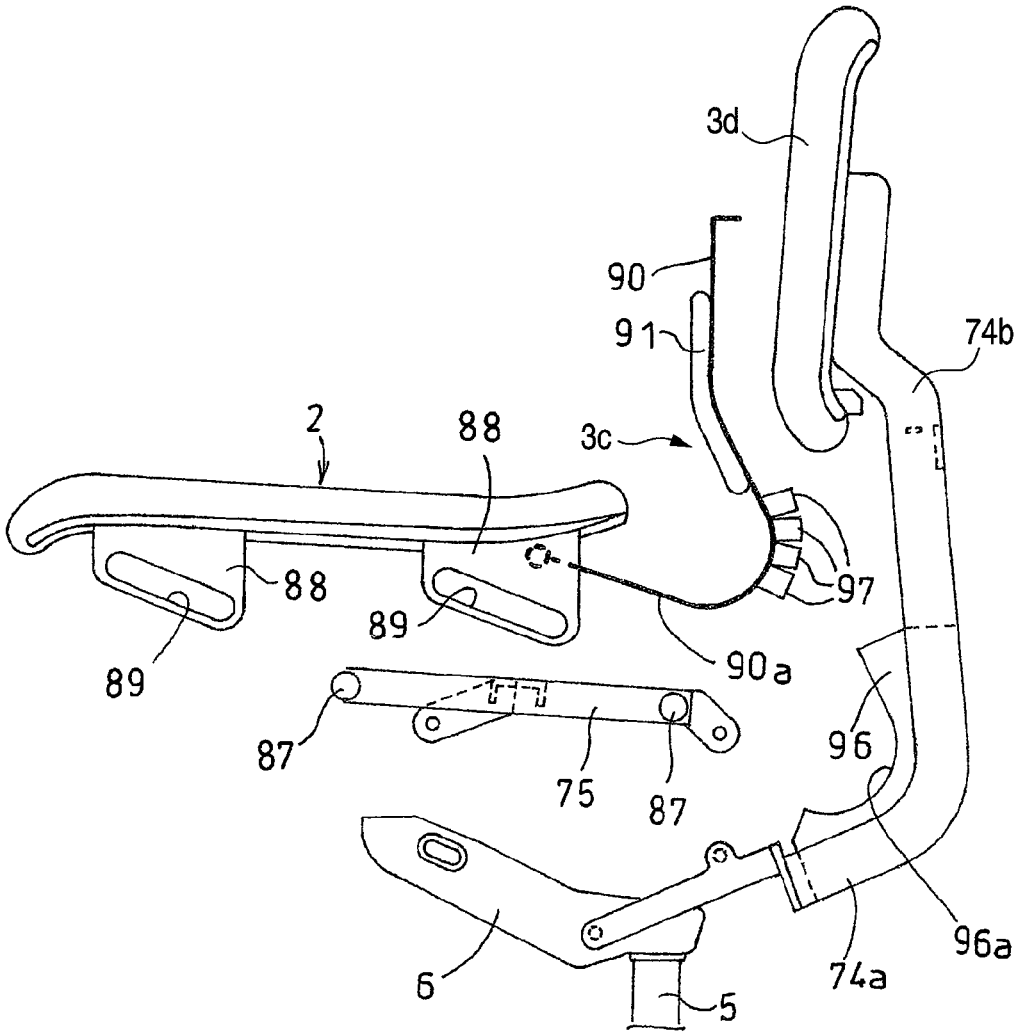
FIG. 27 is a disassembled perspective view of the fourth embodiment.

FIG. 25 shows a third embodiment. Further, although technical terms of the first through the third cooperatively moving links of the embodiment are used, the technical terms are particular to the embodiment and do not coincide with those of the first embodiment.

According to the embodiment, the backrest 3 is constituted by a structure of expanding the cushion member b over the front face of the back inner shell 3*a*. Further, according to the embodiment, an intermediate member 75 is connected relatively pivotably to the first support shaft 8 and the back support frame 74, and the intermediate member 75 is connected with the front and rear support links 7 and 14. The intermediate member 75 and the back support frame 74 are connected by a third support shaft 76.

Further, a lower face of the seat 2 is arranged with a reinforcement member 77 made by a rigid body, and upper ends of the front and rear support links 7 and 14 are connected to the reinforcement member 76. Therefore, the support links 7 and 14 are pivoted smoothly without being influenced by deformation of the seat inner shell. The intermediate member 75 is constituted by a mode of being opened downwardly in a front view thereof. Springs such as a rocking spring are omitted.

At the back support frame 74, the first cooperatively moving link 78 extended substantially in a horizontal shape and a second cooperatively moving link 79 are connected by a common shaft 80, further, an upper end of the second cooperatively moving link 79 and a lower portion of the lumber support portion 3*c* of the back inner shell 3*a* are connected by a third cooperatively moving link 81.

A front end portion of the first cooperatively moving link 78 is formed with a long hole 82 and the long hole 82 is slidably fitted with a guide pin 83 provided at a lower face of the seat 2. Further, the first cooperatively moving link 78 is extended rearward from the shaft 80 and a rear end thereof and an upper/lower middle portion of a second cooperatively moving link 79 are connected with an elongatable and contractable gas cylinder 84 relatively pivotably. The gas cylinder 84 is normally released from being locked and is made to be free to be extended.

According to the embodiment, when the seat 2 is moved back while moving down, the first cooperatively moving link 78 is pivoted in the counterclockwise direction in a state of FIG. 25. Then, the lumber support portion 3*c* of the backrest 3 is moved forwardly by being pressed by the second cooperatively moving link 79 and the gas cylinder 84. Further, the second cooperatively moving link 79 can be recovered to an original attitude independently by pressing to contract the gas cylinder 84. The gas cylinder 84 is an example of spring means, which can also be replaced by a coil spring.

An upper portion 74*a* of the back support frame 74 is separated from a lower portion thereof and the upper portion 74*a* and the lower portion are connected by way of a coil spring 85. Therefore, the upper end portion 74*a* of the back support frame 74 can be inclined forwardly or inclined rearwardly against an elasticity of the coil spring 85. According to the embodiment, the backrest 3 is attached to the back support frame 74 at a portion downward from an upper end thereof to some degree.

(4). Fourth Embodiment

Next, a fourth embodiment will be explained in reference to FIG. 26 through FIG. 29. According to the embodiment, a chair includes an intermediate member 75 connected to the first support shaft 8 and the back support frame 74. The point is the same as that of the third embodiment.

Guide rollers 87 (may be sliders) having left/right longitudinal rotating shafts are transversely projected from both front/rear end portions of the intermediate member 3. On the other hand, bracket plates 88 made of a resin (may be made of a metal) and in a plate-like shape disposed at outer side faces of the intermediate member 75 are provided at portions of a lower face of the seat 2 at both left/right side portions and the two front/rear portions thereof, and the guide rollers 87 are fitted into guide holes 89 formed at the bracket plates 88 and in a rearwardly inclined shape in a side view thereof. Therefore, the seat 2 can be moved down and moved back without changing an attitude in a side view thereof.

The backrest 3 includes a main support 3*d* and a lumber support portion 3*c* arranged downward therefrom. The lumber support portion 3*c* is constituted by a deformable portion a shape of which is deformable in a side view thereof. Further, the back support frame 74 is constituted by left and right arms 74*a* constituting a front portion thereof and left and right back stays 74*b* attached thereto and the main support 3*d* of the backrest 3 is fixed to an upper portion of the back stay 74*b*. Legs are in a mode the same as that of the first embodiment.

The main support 3*d* of the backrest 3 is constituted by a structure of expanding a cushion over a front face of an upper portion inner shell (may be without cushion). On the other hand, the lumber support portion 3*c* includes a resin plate (lower portion inner shell) 90 of polypropylene or the like as a principal member, and a cushion 91 is expanded over a front face of the resin plate 90 at a portion thereof touching a person. Naturally, a cushion can be dispensed with, further as means for softening the touch to a person, a rubber matter material of elastomer or the like can also be expanded. Further, a metal plate such as a leaf spring can also be used in place of the resin plate 90.

As is clearly shown in FIG. 26B, an upper end of the resin plate 90 is attached to a supporter 92 provided at a back face of a lower end portion of the main support 3*d* by way of a hinge 93. Therefore, the resin plate 90 can be pivoted in a front and rear direction easily centering on an upper end thereof. The supporter 92 may be molded integrally with an inner shell of the main support 3*d*, or may be constituted by a member separate from the inner shell. Further, the upper end of the resin plate 90 may be attached to the back stay 74*b*.

The resin plate 90 includes an extended portion 90*a* extended to a lower side of the seat 2, and a front end of the extended portion 90*a* is attached to a lower face of a rear portion of the seat 2. That is, as shown by FIG. 26C, by attaching a left/right longitudinal rod 95 to a plurality of left and right bearing portions 94 formed at a lower face of the seat inner shell 2*a* and winding the front end portion of the extended portion of the resin plate 90 around the rod 95, the front end of the extended portion of the resin plate 90 is formed in a cylindrical shape and the cylindrical state is held by a screw. Therefore, the front end of the extended portion 90*a* of the resin plate 90 can easily be pivoted centering on the rod 95. Further, the front end of the extended portion 90*a* of the resin plate 90 may be fixed to the lower face of the seat 2 by a screw or the like.

Figure 28:
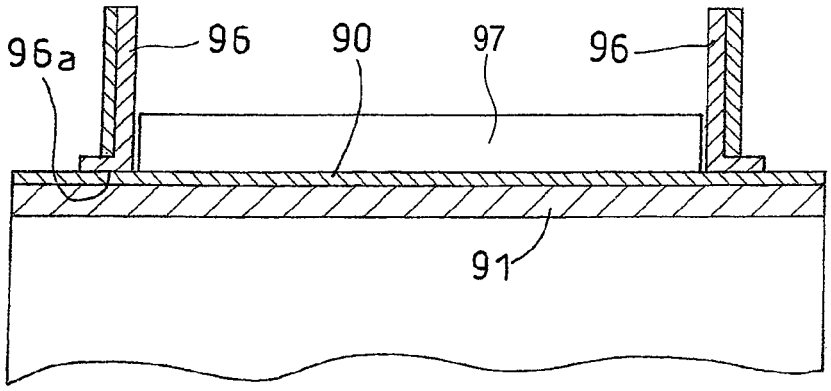
FIG. 28 is a sectional view taken along a line XXVIII-XXVIII of FIG. 26A.

A considerable interval is constituted between a rear end of the seat 2 and the back stay 74*b* in an unseated state. Further, the back stay 74*b* is fixedly attached with a guide member 96 having a guide face 96*a* bent in a recessed shape in a skewed upper direction to look up a rear end of the seat 2 in a side view thereof. The guide member 96 is made of resin and is fixed to left and right back stays 74*b* by screw fastening or the like as shown by FIG. 28. Further, the back stay 74 may integrally be provided with the guide member 96.

A portion of a back face of the resin plate 90 disposed at the recessed portion of the guide member 96 in an unseated state is fixedly attached with or integrally molded with a plurality of stages of deformation restricting members 97 in a block-like shape. The deformation restricting member 97 is disposed between the left and right guide members 96, and therefore, the deformation restricting member 97 also achieves a function of preventing the resin plate 90 from being deviated in a left and right direction. Although a portion of the resin plate 90 provided with the deformation restricting member 97 is deformed in a forward recessed shape, the portion is not deformed in a forward projected shape. That is, a directionality of deformation of the resin plate 90 is provided by the deformation restricting member 97.

A portion of the resin plate 90 between an upper end thereof and the guide member 96 is bent in a forward projected shape in a side view although slightly. This is for providing an initial directionality for forwardly projecting the resin plate 90 by making a person seated. The guide plate 96 may be extended up to an upper end portion of the resin plate 90.

Figure 29:
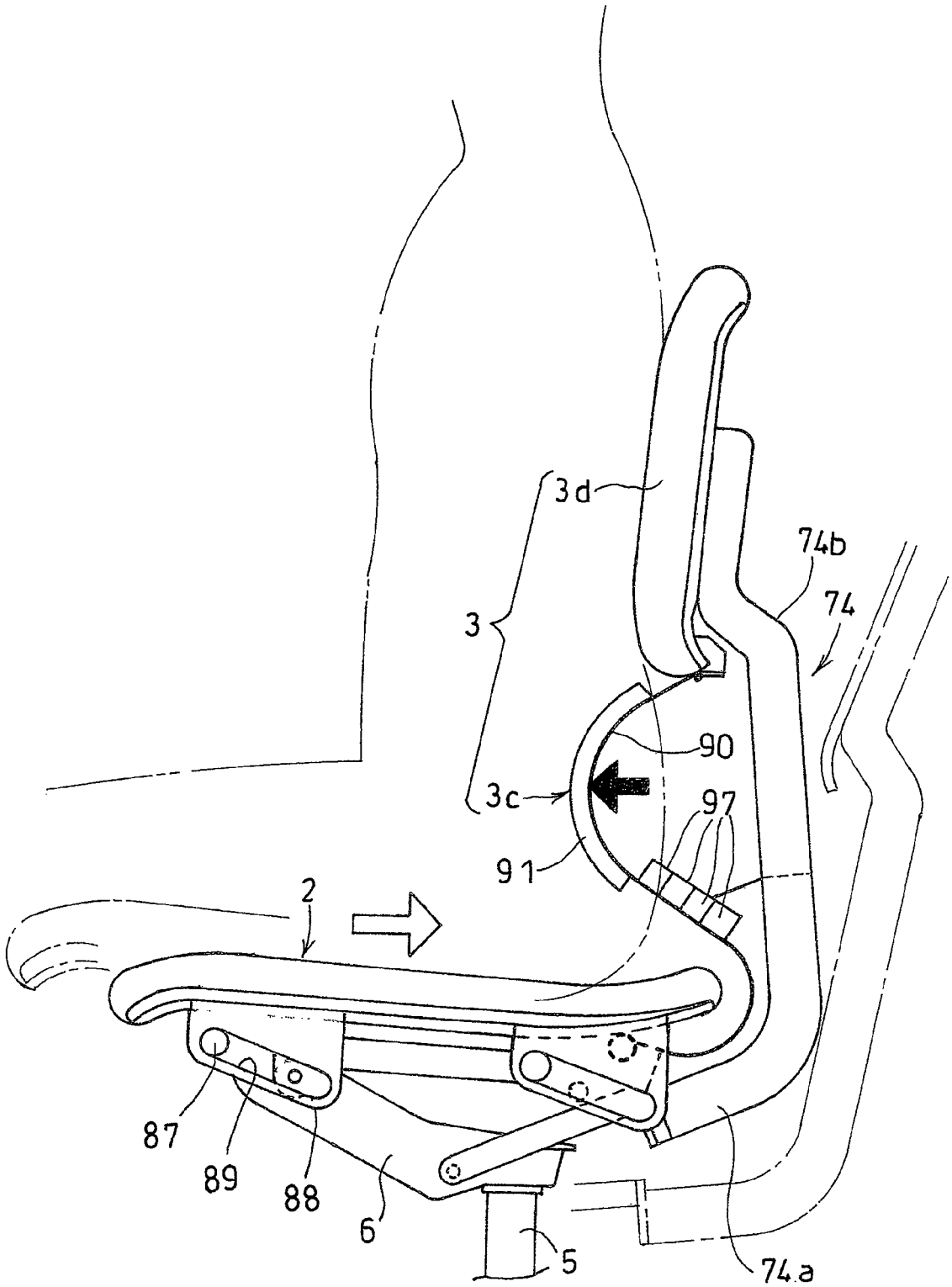
FIG. 29 is a view showing movement of the fourth embodiment.

In the above-described constitution, when a person is seated thereon, the seat 2 is moved back while moving down without changing an attitude in a side view, and in accordance with the movement of the seat 2, the extended portion 90*a* of the resin plate 90 is pushed out to a lower end portion of the guide member 96. Then, since a total length of the resin plate 90 remains unchanged, the resin plate 90 operated to be stretched is projected forwardly while being bent in a forward projected shape at a portion thereof upward from the guide member 96 as shown by FIG. 29 by a guiding operation of the bent guide face 96*a* of the guide member 96. Thereby, even when a person is seated shallowly on the seat 2, the waist portion of the person can precisely be supported by the resin plate 90 (lumber support portion 3*c*).

In this case, by providing the resin plate 90 with the deformation restricting member 97, a portion of the resin plate 90 provided with the deformation restricting member 97 is held substantially in a linear state in a side view thereof, and therefore, the resin plate 90 is bent in the forward projected shape to be projected firmly, and even when a body pressure of a person is operated to the resin plate 90, the shape bent in the forward projected shape is not collapsed. That is, the resin plate 90 is bent in a constant state by the deformation restricting member 97, further, the bent shape is maintained constant.

Although even when a person is deeply seated on the seat 2, the resin plate 90 is projected forwardly by the same amount, since the resin plate 90 is provided with a flexibility, the person does not feel a sense of oppression even in a deeply seated state, rather, the resin plate 90 is firmly fitted to the waist.

As means for ensuring a pertinent fitness even when a person is seated variously, or seated deeply or seated shallowly, an amount of forwardly projecting the lumber support portion 3*c* may be adjusted automatically in accordance with the seated state. As means therefor, other than deforming the resin plate 90 in a plane view, the following is conceivable.

That is, (a). escape movement of the upper end of the resin plate 90 is supported by spring means (not illustrated), and when a resistance to some degree or more is applied, the resin plate 90 is escaped in a skewed upper direction against the spring means, (b). contrary to the above-described a, by arranging spring means between the lower end of the resin plate 90 and the seat 2 and escaping the resin plate 90 to the lower side of the seat 2, when a resistance to some degree or more is applied, the resin plate 90 is prevented from being deformed even when the seat 2 is slid, (c). by attaching the guide member 96 to the back support frame 74 in a state of capable of being rearwardly moved or rearwardly inclined and supporting rearward movement or rearward inclination of the guide member 96 by spring means, when a press force to some degree is exerted, the resin plate 90 is prevented from being moved forward, (d). a pertinent portion of the resin plate 90 other than a portion of touching the waist of a person is provided with a buffer portion deformed in a projected shape or a zigzag shape in a side view thereof when an external force becomes to some degree or more.

The embodiment can be embodied in still other mode. For example, an amount of deforming a deformable portion such as the resin plate 90 can be adjusted. As specific adjusting means, it is conceivable to be able to adjust a position of attaching the upper or the lower end of the resin plate 90, or to be able to adjust a distance until a stretch force is operated to the resin plate 90 from when the seat 2 starts sliding.

(5). Others

The invention can be embodied variously other than the above-described embodiments. For example, as means for moving a seat by making a person seated thereon, for example, a system of fitting a guide rail and a roller can also be adopted.

Further, as cooperatively moving means for changing movement of a seat into forward movement of the lumber support portion, the means is not limited to a link mechanism but, for example, it is possible that a pressure is applied to an oil by moving down a seat, and the lumber support portion is pushed out by a cylinder (piston) operated by a pressurized oil thereof. Further, as other example of cooperatively moving means, it is possible that downward movement of a seat by being seated is changed into a force of pulling a wire, and the lumber support portion is pushed out by pulling the wire. Naturally, a hydraulic pressure and a wire and a link can be used.

Further, an object of applying the invention is not limited to a revolving type chair attached with casters but the invention is applicable to other type of a chair such as a chair constituting a leg that is a frame structure. Further, a mode or a material of the back support frame can be set freely as necessary. In the specification of the application, only a portion of the embodiments of the application disclosed in the application claiming priority is described. This is for reducing a volume of the specification and the invention includes all of the respective embodiments.

The invention claimed is:

1. A chair comprising:

a seat;

a seat receiving member supporting the seat, the seat receiving member being configured to move the seat at least one of downward and rearward in response to a person being seated on the seat;

a backrest including a lumbar support portion that supports the lumbar of the seated person at a lower portion of the backrest; and a cooperative moving unit configured to forwardly move the lumbar support portion of the backrest in response to at least one of the downward and rearward movement of the seat, wherein the backrest is flexible to deform in a side view and a plane view by being pressed by the seated person;

an upper portion of the back rest being connected to a back supporter, the lumbar support portion being connected to the cooperative moving unit;

the lumbar support portion is moved forwardly and rearwardly by inclining the backrest centering on the upper portion of the back rest in a side view thereof; and the backrest includes a back plate formed of a synthetic resin including an elastomer, and a plurality of vertically prolonged ribs are formed at one of a front face, a rear face, and both the front and the rear face of the back plate.

2. A chair comprising:

a seat;

a seat receiving member supporting the seat, the seat receiving member being configured to move the seat at least one of downward and rearward in response to a person being seated on the seat;

a backrest including a lumbar support portion that supports the lumbar of the seated person at a lower portion of the backrest; and a cooperative moving unit configured to forwardly move the lumbar support portion of the backrest in response to at least one of the downward and rearward movement of the seat, wherein the seat receiving member moves the seat downward without changing an attitude of the seat in a side view of the seat when the person is seated; and the lumbar support portion of the backrest is moved forward in response to at least one of the downward and rearward movement of the seat.

3. A chair comprising:

a seat;

a seat receiving member supporting the seat, the seat receiving member being configured to move the seat at least one of downward and rearward in response to a person being seated on the seat;

a backrest including a lumbar support portion that supports the lumbar of the seated person at a lower portion of the backrest, a cooperative moving unit configured to forwardly move the lumbar support portion of the backrest in response to at least one of the downward and rearward movement of the seat;

a base provided at an upper end of a leg stay;

a back support frame rearwardly inclinably connected to the base; and a rocking spring that elastically supports a rearward inclining movement of the back support frame;

wherein the seat is supported by the base and the back support frame such that the seat moves downward and the back support frame rearwardly inclines without changing an attitude of the seat as viewed from a side of the seat when the person is seated; and a spring force of the rocking spring is set such that the rocking spring is not elastically deformed when the person is seated but not leaning on the backrest, and is elastically deformed when the person is seated and is leaning on the backrest.

4. A chair comprising:

a seat;

a seat receiving member supporting the seat, the seat receiving member being configured to move the seat at least one of downward and rearward in response to a person being seated on the seat;

a backrest including a lumbar support portion that supports the lumbar of the seated person at a lower portion of the backrest;

a cooperative moving unit configured to forwardly move the lumbar support portion of the backrest in response to at least one of the downward and rearward movement of the seat;

a base provided at an upper end of a leg stay;

a back support frame rearwardly inclinably connected to the base; and a rocking spring that elastically supports a rearward inclining movement of the back support frame;

wherein the seat is connected to the base and the back support frame such that the seat moves downward and rearward without changing an attitude of the seat in a side view of the seat when the person is seated by way of the seat receiving member being provided with a first link mechanism;

the seat is biased in an upward direction by the spring; and the back support frame is provided with a second link mechanism that converts the rearward movement and the downward movement of the seat into the forward movement of the lumbar support portion of the backrest, the second link mechanism being included in the cooperative moving unit.

5. A chair comprising:

a seat;

a seat receiving member supporting the seat, the seat receiving member being configured to move the seat at least one of downward and rearward in response to a person being seated on the seat;

a backrest including a lumbar support portion that supports the lumbar of the seated person at a lower portion of the backrest; and a cooperative moving unit configured to forwardly move the lumbar support portion of the backrest in response to at least one of the downward and rearward movement of the seat;

wherein the backrest includes a flexible lumbar support portion deformable in a side view direction thereof, and a rigid main support portion disposed upward from the flexible lumbar support portion;

the main support portion of the backrest is attached to a back support frame;

an upper end of the lumbar support portion is connected to an upper support portion or the back support frame and a lower end thereof is movably held;

the lumbar support portion is deformed in a direction such that a lower portion of the lumbar support portion is moved upwardly by a stretching operation from a lower side;

the lumbar support portion is deformed in a projected shape and moved forwardly in a side view thereof; and the back support frame is provided with a guide unit for moving the lower portion of the lumbar support portion upwardly when the person is seated and the guide unit is included in the cooperative moving unit.

6. The chair according to claim 5, further including:

a base provided at an upper end of a leg stay;

the back support frame rearwardly inclinably connected to the base; and a rocking spring that elastically supports a rearward inclining movement of the back support frame;

wherein the seat is supported by the base and the back support frame by the guide unit such that the seat moves rearward and downward without changing an attitude of the seat in a side view of the seat when the person is seated; and a downward directed extended portion having a flexibility is continuous to a lower portion of the lumbar support portion, a front end thereof is connected to a rear portion of the seat, the back support frame is provided with a guide portion by which the seat is moved down and moved back; and the downward directed extended portion of the lumbar support portion is moved to the main support portion of the back rest.

* * * * *